US005950289A

United States Patent [19]

Tanaka

[11] Patent Number: 5,950,289

[45] Date of Patent: Sep. 14, 1999

[54] ELECTRONICALLY CONTROLLED SAMPLE WARPER WITH YARN EXCHANGE MECHANISM

[75] Inventor: Yoshihiro Tanaka, Kiryu, Japan

[73] Assignee: Suzuki Warper Ltd., Kiryu, Japan

[21] Appl. No.: 09/034,024

[22] Filed: Mar. 2, 1998

[30] Foreign Application Priority Data

Jun. 3, 1997 [JP] Japan ..... 9-145391

[51] Int. Cl.[6] ..... D02H 3/00

[52] U.S. Cl. ..... 28/190; 28/184

[58] Field of Search ..... 28/184, 190, 172.1, 28/191, 192, 198, 199

[56] References Cited

U.S. PATENT DOCUMENTS

| | | | |
|---|---|---|---|
| 4,972,562 | 11/1990 | Tanaka et al. | 28/190 |
| 5,410,786 | 5/1995 | Bogucki-land | 28/191 |
| 5,630,262 | 5/1997 | Tanaka | 28/190 |

FOREIGN PATENT DOCUMENTS

| | | | |
|---|---|---|---|
| 0 375 480 | 6/1990 | European Pat. Off. . | |
| 0 652 310 | 5/1995 | European Pat. Off. . | |
| 44 22 098 | 1/1996 | Germany . | |
| 2097934 | 5/1987 | Japan | 28/184 |
| 91/19030 | 12/1991 | WIPO . | |

*Primary Examiner*—Amy Vanatta
*Attorney, Agent, or Firm*—Nikaido, Marmelstein, Murray & Oram LLP

[57] ABSTRACT

An electronically controlled sample warper includes a yarn introduction member movably mounted on a distal end of a yarn introduction lever rotatably provided on a side surface of a warper drum for winding a yarn on the warper drum, and a plurality of yarn selection guides disposed, in correspondence with the yarn introduction member, on an end portion of a base on which the warper drum is supported. Each of the yarn selection guides is movable angularly about the base between a yarn exchange position in which it projects from the base for changing the yarn to another yarn, and a standby position in which it is retracted in the base for storing the yarn in the base. The yarn introduction member and each of the yarn selection guides are cooperative to undertake delivery of a yarn between them so as to wind yarns on the warper drum in the preset order with automatic yarn change. For delivery of the yarn from the yarn introduction member to any of the yarn selection guides, the yarn introduction member moves in a direction to release the yarn to thereby allow the yarn to be caught by the yarn selection guide, and for delivery of the yarn from the yarn selection guide to the yarn introduction member, the yarn introduction member moves in another direction to catch the yarn held on the yarn selection guide.

17 Claims, 24 Drawing Sheets

ELECTRONICALLY CONTROLLED SAMPLE WARPER WITH YARN EXCHANGE MECHANISM

BACKGROUND OF THE INVENTION

1. Field of the Invention

This invention relates generally to an electronically controlled sample warper having one or more yarn introduction levers to warp yarns on a warper drum in the preset order with automatic yarn change, and more particularly to such an apparatus which enables efficient exchange of yarns to be wound on the warper drum.

2. Description of the Related Art

Conventional electronically controlled sample warpers are disclosed, for example, in Japanese Patent Publication No. SHO 64-8736. The disclosed sample warper includes driving and driven shafts projecting centrally from opposite ends of a hollow shaft. A first small gear fixed to a pulley is loosely mounted on the driving shaft, while a second small gear fixed to a yarn introduction lever is loosely mounted on the driven shaft. The first and second small gears are cooperative with each other via meshing engagement with third and fourth small gears, respectively, mounted on opposite ends of a cooperation shaft extending through the hollow shaft. The hollow shaft is cantilevered at the driving-shaft side. Drum frames are mounted on the driven-shaft side of the hollow shaft and each have an outer periphery having alternately an arcuate portion and a straight portion. A pair of rollers is disposed one on the arcuate portion of each of the drum frames. A warper drum is loosely mounted on the hollow shaft and has horizontal drum spokes carrying the rollers around which conveyor belts are wound. The conveyor belts are simultaneously driven to a common amount of fine movement by a drive member threadedly engaged with interior screw shafts of planetary gears meshing with a sun gear suitably driven from the exterior. As the sun gear rotates, the planetary gears rotate concurrently. The yarn introduction lever has a distal end bent inwardly to provide a yarn introducing part disposed adjacent to the front end of the outer periphery of the warper drum. The warper also includes: a shedding means for forming a shed and a cut shed by selecting warp yarns (to be wound on the warper drum) over and under shedding bars and cut shedding bars; a total yarns counter count means for rendering an up signal, of a total counter for counting the total number of the warp yarns, to be on or off; a total yarns completion termination means for terminating the operation of the warper when the total number of the warp yarns reaches a predetermined value; a conveyor belt leftward moving means for moving the conveyor belt leftwardly; a conveyor belt rightward moving means for moving the conveyor belt rightwardly; an operation/termination means for transmitting the rotation of a main motor to the yarn introduction lever; a yarn selection means for controlling a yarn selection guide and a yarn removing unit; a yarn pressing solenoid means for rendering a solenoid of a yarn slack preventing (yarn pressing) unit operative and inoperative; and a windings count means for counting the number of windings of the yarns so as to display the counted result. By selecting the kind of yarn 0-n, and setting the number of yarn, the number of repeats, the number of windings, the quantity of movement or feed of the conveyor belt, a desired pattern of warping can be achieved automatically.

The electrically controlled sample warper described above has been developed by the present assignee and has acquired a good reputation for its capability of automatic pattern warping.

However, in this conventional sample warper, since the main motor is comprised of an ordinary motor, it is impossible to vary the rate of rotations during operating so that miscatches and mischanges as well as yarn breakage are inevitable when exchanging yarns. Furthermore, it is impossible to perform cushion start and stop, and jogging operation, thus posing a room for improvement in the operation efficiency.

For setting the density of warp yarns, the rate of moving the conveyor belt is determined by varying the gear ratio of speed change gears operatively connected to the main motor. Since the conveyor belt is moved even during idling, regular windings of yarn on the warper drum are difficult to achieve so that the tension and the warping length would finally vary during the winding operation.

In order to overcome the above-mentioned problems, proposals have been made by the present assignee to employ an inverter motor and an AC servo motor in the sample warper (Japanese Patent Publications Nos. SHO 64-10609 and SHO 64-10610).

In a sample warper provided in accordance with another prior proposal, a plurality of warp yarns can be concurrently wound on a warper drum with omitting a yarn exchanging step to eliminate any time loss for the yarn exchange, thus reducing the warping time (Japanese Patent Publication No. HEI 4-57776).

According to a further improvement proposed by the present assignee, warping on a sample warper is performed such that after a first winding of yarn is formed on a warper drum, the yarn for the next winding is placed ahead of an end of the first or preceding winding of yarn. Thus, the sample warper is able to warp yarns on the warper drum, with windings of the yarns neatly layered one above another in regular order, thereby enabling the yarns to be readily rewound on beans on a weaving machine even when the warping length is relatively large (Japanese Patent Laid-open Publication No. HEI 7-133538).

The improved sample warpers have already acquired a very good reputation.

The proposed electronically controlled sample warpers have a yarn exchange mechanism illustrated in FIG. 24 of the accompanying drawings. As shown in this figure, a yarn selection guide unit 27 has a plurality of yarn selection guides 27*a*–27*j* for selecting and guiding a yarn 22. The yarn selection guides 27*a*–27*j* each have one rotary solenoid 29 associated therewith. When the rotary solenoid 29 is turned on, the corresponding yarn selection guide 27*a*–27*j* is angularly moved or turned in one direction to advance to an operating position (yarn exchange position). Conversely, when the rotary solenoid 29 is turned off, the yarn selection guide 27*a*–27*j* is turned in the opposite direction to return to a standby position. In the conventional yarn exchange mechanism, a yarn introduction lever 6 is used to wind the yarn 22 on a warper drum A while exchanging the yarn 22. The yarn 22 supplied from a creel passes between a yarn introduction cover 59 and a stop plate S, then is held by the yarn introduction lever 6, and subsequently wound on the warper drum A. The yarn selection guides 27*a*–27*j* have a shape or configuration which, as shown in FIG. 25, is formed by a straight arm (27*e* being shown) bent at its distal end portion in the same direction as the direction of rotation of the yarn introduction lever 6.

In the conventional sample warper, when the yarn 22*a* on the yarn selection guide 27*a* is to be changed to a yarn 22*e* on the yarn selection guide 27*e*, for example, a yarn removing unit 32 mounted on a base Y is activated so that after the yarn introduction lever 6 has passed the yarn selection guide device 27, the yarn 22*a* is removed by a yarn remover 32*a* from the yarn introduction lever 6 (FIG. 26). A guide rod 59*a* projecting from the inner surface of a lower portion of the yarn introduction cover 59 guides the removed yarn 22 between the base Y and the stop plate S where the removed yarn 22 abuts on one yarn selection guide 27*a* which has already been advanced to the yarn exchange position and urged against the stop plate S (FIG. 27).

Then the yarn selection guide 27*a* is turned toward the base Y to retract into the standby position during which time the removed yarn 22*a* is held or caught by the yarn selection guide 27*a* and received in the base Y (FIG. 28).

Thereafter, the yarn selection guide 27*e* holding thereon a yarn 22*e* to be next wound on the warper drum A is turned from the base Y toward the stop plate S to reach the yarn exchange position (FIG. 29). Then, the yarn introduction lever 6 passes the position of the yarn selection guide 27*e* in which instance the yarn 22*e* is caught by the yarn introduction lever 6. The yarn 22*e* while being caught by the yarn introduction lever 6 is then wound on the warper drum A (FIG. 30). The yarn selection guide 27*e* is turned to return to its standby position and held in the standby position while the yarn 22*e* is continuously wound on the warper drum A (FIG. 31). By the foregoing sequence of operations, the yarn exchange is performed.

In the conventional yarn exchange mechanism, however, the yarn remover 32*e* is inserted between the yarn introduction lever 6 and the stop plate S so as to keep the yarn 22 immovable in the direction of rotation between the creel and the yarn remover 32*a* until the yarn 22 is removed from the yarn introduction lever 6.

The yarn 22 which is prevented by the yarn remover 32*a* from moving in the rotating direction is detached from the yarn introduction lever 6 while sliding on the same.

In this instance, the yarn 22 needs to be continuously supplied from the creel during a time from its abutment on the yarn remover 32*a* to its detachment from the yarn introduction lever 6. Since the yarn during the yarn changing passes along a different path from the yarn while being wound on the warper drum A, the length of the yarn required for the yarn changing is further elongated. In addition, due to the use of the yarn remover 32*a*, the yarn is subjected to an impact force or shock when it is removed or released from the yarn introduction lever 6.

For the reasons described above, the removed yarn tends to slack or is affected by static electricity before it is received or store in the base Y, failing to be received adequately in the base Y.

This problem becomes serious when the yarn exchange is performed at high speeds. Accordingly, high speed yarn change is difficult to achieve. In addition, since the yarn remover 32*a* is attached to the base Y, only one position is available for the attachment of the yarn remover 32. Accordingly, those yarn which are located remotely from the yarn remover 32*a* cannot be exchanged without difficulties, resulting a limited total number of yarns that can be used on the sample warper.

SUMMARY OF THE INVENTION

With the foregoing drawbacks of the prior art in view, it is a general object of the present invention to provide an electronically controlled sample warper having a yarn exchange mechanism which is capable of performing exchange of yarns with reliability and at high speeds.

A more specific object of the present invention is to provide an electronically controlled sample warper with a yarn exchange mechanism, which is capable of reducing the length of yarn required for the yarn exchange by at least 50% of the conventional process and preventing the tension of a yarn from changing abruptly when the yarn is detached, thereby improving the warping quality while increasing the yarn change speed to approximately twice the conventional process wherein the warping quality is degraded due to unstable yarn tension while the yarn exchange is performed.

Another object of the present invention is to provide an electronically controlled sample warper having a yarn exchange mechanism, which includes a plurality of yarn introduction member actuating unit bodies disposed on respective positions on a yarn introduction cover for enabling the use of more than 20 bobbins to realize warping of a complicated design pattern.

According to one preferred form of the present invention, there is provided an electronically controlled sample warper, comprising a yarn introduction member movably mounted on a distal end of at least one yarn introduction lever rotatably provided on a side surface of a warper drum for winding a yarn on the warper drum; and a plurality of yarn selection guides disposed, in correspondence with the yarn introduction member, on an end portion of a base on which the warper drum is supported, each of the yarn selection guides being movable angularly about the base between a yarn exchange position in which it projects from the base for changing the yarn to another yarn, and a standby position in which it is retracted in the base for storing the yarn in the base, wherein the yarn introduction member and each of the yarn selection guides are cooperative with each other to undertake delivery of a yarn between them so as to wind yarns on the warper drum in the preset order with automatic yarn change, and wherein when the yarn is to be delivered from the yarn introduction member to one of the yarn selection guides, the yarn introduction member moves in a first direction to release the yarn therefrom to thereby allow the yarn to be caught by said one yarn selection guide, and when the yarn is to be delivered from said one yarn selection guide to the yarn introduction member, the yarn introduction member moves in a second direction to catch the yarn held on said one yarn selection guide.

Preferably, the yarn introduction member is angularly movably attached to the distal end of the yarn introduction lever, and the yarn introduction member is turned in one direction to release the yarn therefrom and in the opposite direction to catch the yarn held on said one yarn selection guide.

According to another form of the present invention, there is provided an electronically controlled sample warper, comprising: a yarn introduction member movably mounted on a distal end of at least one yarn introduction lever rotatably provided on a side surface of a warper drum for winding a yarn on the warper drum; and a plurality of yarn selection guides disposed, in correspondence with the yarn introduction lever, on an end portion of a base on which the warper drum is supported, each of the yarn selection guides being movable angularly about the base between a yarn exchange position in which it projects from the base for changing the yarn to another yarn, and a standby position in which it is retracted in the base for storing the yarn in the base, wherein the yarn introduction member and each of the yarn selection guides are cooperative with each other to undertake delivery of a yarn between them so as to wind yarns on the warper drum in the preset order with automatic yarn change, wherein the yarn introduction member has a yarn holding member movably mounted thereon, and wherein when the yarn is to be delivered from the yarn introduction member to one of the yarn selection guides, the yarn holding member moves in a first direction to release the yarn therefrom to thereby allow the yarn to be caught by said one yarn selection guide, and when the yarn is to be delivered from said one yarn selection guide to the yarn introduction member, the yarn holding member moves in a second direction to catch the yarn held on said one yarn selection guide.

Preferably, the yarn holding member is attached to a distal end of the yarn introduction member so as to be reciprocally movable between a first position in which it is retracted into the yarn introduction member to release the yarn, and a second position in which it projects from the yarn introduction member to catch the yarn.

As an alternative, the yarn holding member may be angularly movably attached to a distal end of the yarn introduction member in which instance the yarn holding member is turned in one direction to retract into the yarn introduction member for releasing the yarn therefrom and in the opposite direction to project from the yarn introduction member for catching and holding the yarn.

In order to enable the yarn to pass or move along the same passage as it is being wound on the warper drum and also as it is changed to another yarn, it is preferably to use a guide cover attached to the side surface of the warper drum, and a guide bar attached at its one end to a lower end portion of the yarn introduction cover.

The other end (distal end) of the guide bar is preferably bent in the same direction as the direction of rotation of the yarn introduction member so as to allow the yarn to pass between the guide bar and each of the yarn selection guides both when the yarn is being wound on the warper drum and when the yarn is changed to another yarn.

It is preferable that the yarn introduction member is activated by a plurality of yarn introduction member actuating unit bodies disposed on an end face of the warper drum or a yarn introduction cover disposed on the end face of the warper drum, and the yarn introduction member actuating unit bodies are activated in accordance with a preset yarn exchange order so as to operate the yarn introduction member.

Preferably, the electronically controlled sample warper may further include a plurality of sensors mounted on the end face of the warper drum or on the yarn introduction cover for sensing the yarn introduction lever so as to generate a yarn introduction lever detection signal to activate the yarn introduction member actuating unit bodies in the preset yarn exchange order.

Preferably, the electronically controlled sample warper may further include a plurality of sensors mounted on the end face of the warper drum or on the yarn introduction cover for sensing the yarn introduction lever so as to generate a yarn introduction lever detection signal to activate the yarn holding members in the preset yarn exchange order.

According to the present invention, it is possible to omit a stop plate which is required for the conventional sample warper to differentiate a passage of a yarn being wound on the warper drum and from a passage of the yarn as it is changed to another yarn. The yarn is thus able to pass the same passage while it is being wound on the warper drum and as it is changed to another yarn.

The above and other objects, features and advantages of the present invention will become manifest to those versed in the art upon making reference to the following detailed description and the accompanying sheets of drawings in which preferred structural embodiments incorporating the principles of the present invention are shown by way of illustrative example.

DETAILED DESCRIPTION

Certain preferred embodiments of the present invention will be described below in greater detail with reference to the accompanying sheets of drawings.

Figure 1:
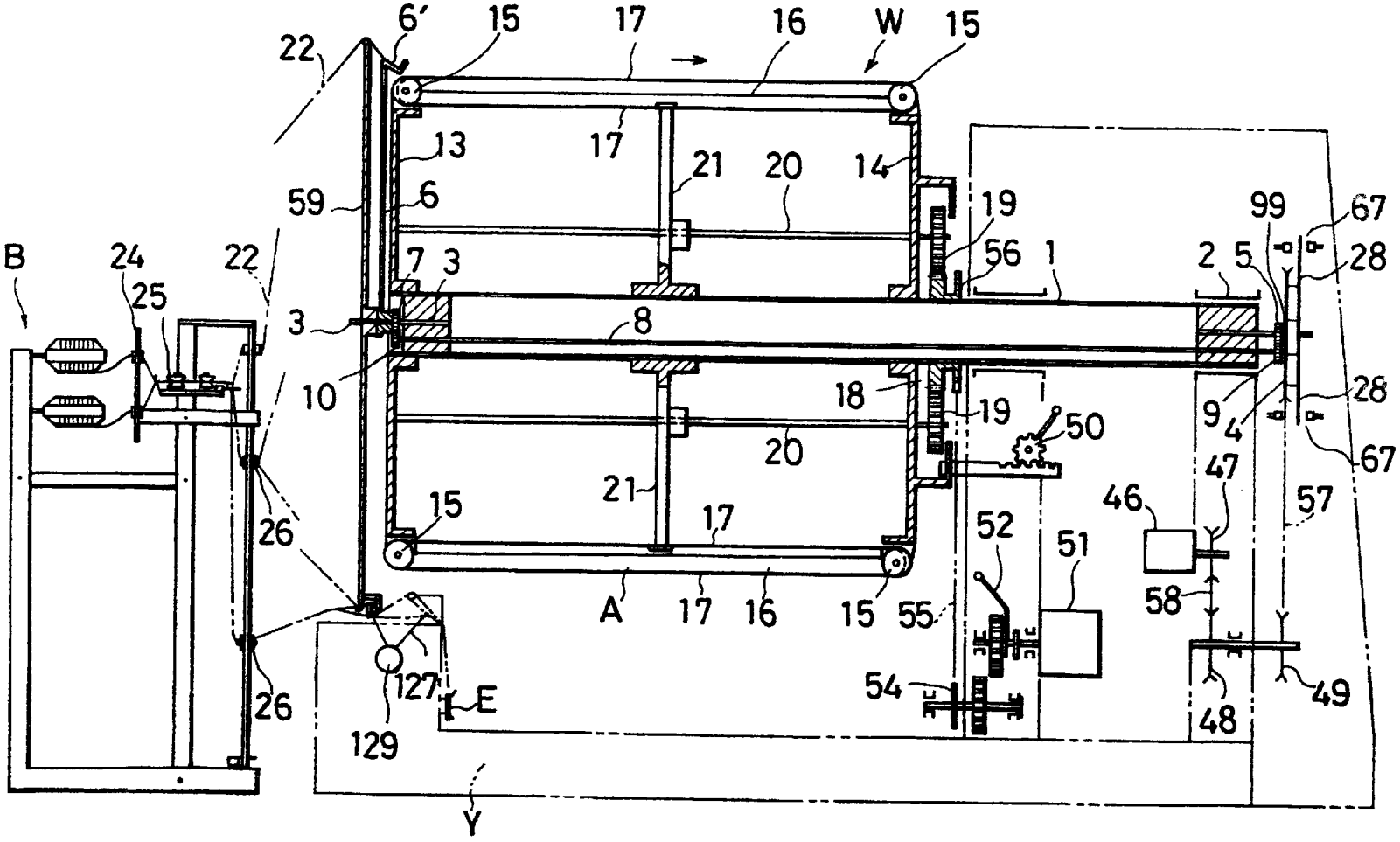
FIG. 1 is a diagrammatical side view, with parts broken away, of an electronically controlled sample warper embodying the present invention, which is associated with a fixed creel.

FIG. 1 shows an electronically controlled sample warper W according to the present invention. The sample warper W has a hollow shaft 1. A driving shaft 2 and a driven shaft 3 project centrally from respective opposite ends of the hollow shaft 1. On the driving shaft 2, a first small gear 4 and a pulley 99 both fixed to a pulley 4 are loosely mounted. On the driven shaft 3, a second gear 7 to which a yarn introduction lever 6 is fixed is loosely mounted. The yarn introduction lever 6 in the illustrated embodiment is only one, however, two or more yarn introduction levers may be provided.

The first and second small gears 5, 7 are in meshing engagement with third and fourth small gear 9, 10, respectively, which are mounted on opposite ends of a cooperating shaft 8 extending through the hollow shaft 1. The hollow shaft 1 is cantilevered at the driving-shaft side. On the driven-shaft side of the hollow shaft 1, a warper drum A is loosely mounted.

Figure 2:
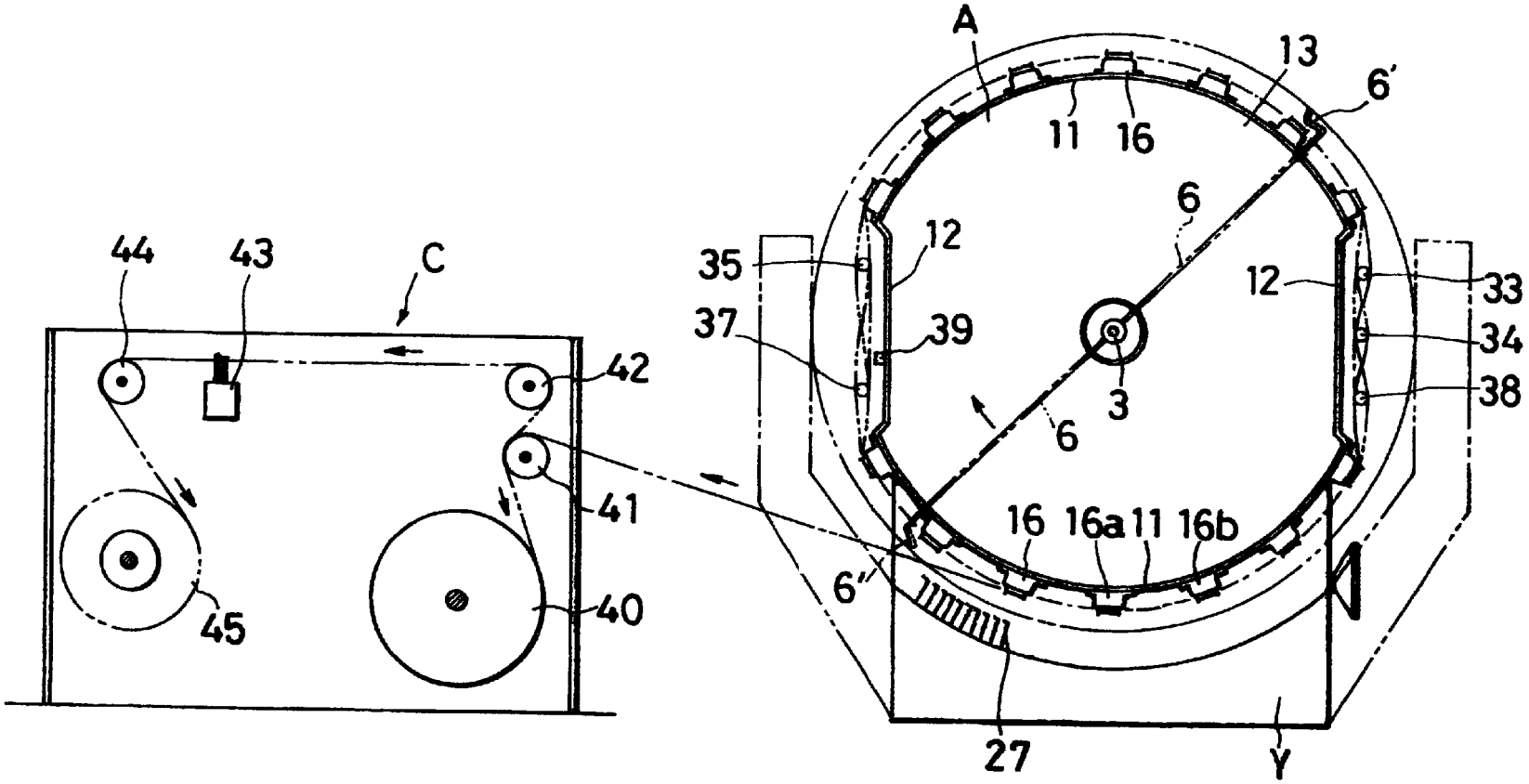
FIG. 2 is a front elevational view of the sample warper, which is associated with a rewinder.

The warper drum A, as shown in FIG. 2, is composed of a pair of drum frames 13, 14 each having an outer periphery having alternately arcuate and straight portions 11, 12. The warper drum A also includes a plurality of horizontal drum spokes 16 each supporting on its opposite ends a pair of rollers 15, 15 each resting on the arcuate portion 11 of each drum frame 13, 14. A conveyor belt 17 (FIG. 1) is wound around each pair of rollers 15, 15.

All of the conveyor belts 17 are driven concurrently to a common amount of fine movement by a driving member 21 threadedly engaged with interior screw shafts 20 of planetary gears 19 which are in meshing engagement with a sun gear 18 all for co-rotation therewith, the sun gear 18 being suitably driven from the exterior of the warper drum A. The distal end of the yarn introduction lever 6 is inwardly bent to provide a yarn introduction part 6' which is disposed adjacent to the front end of the outer periphery of the warper drum A.

In FIG. 1 reference character B denotes a fixed creel for supporting a plurality of bobbins on which various yarns 22 of different colors are to be wound respectively. Numeral 24 designates a guide plate for guiding the yarns 22 drawn out from the bobbins; 25, a tension regulator for adjusting the tension of the yarns 22; and 26, a dropper ring.

Figure 4:
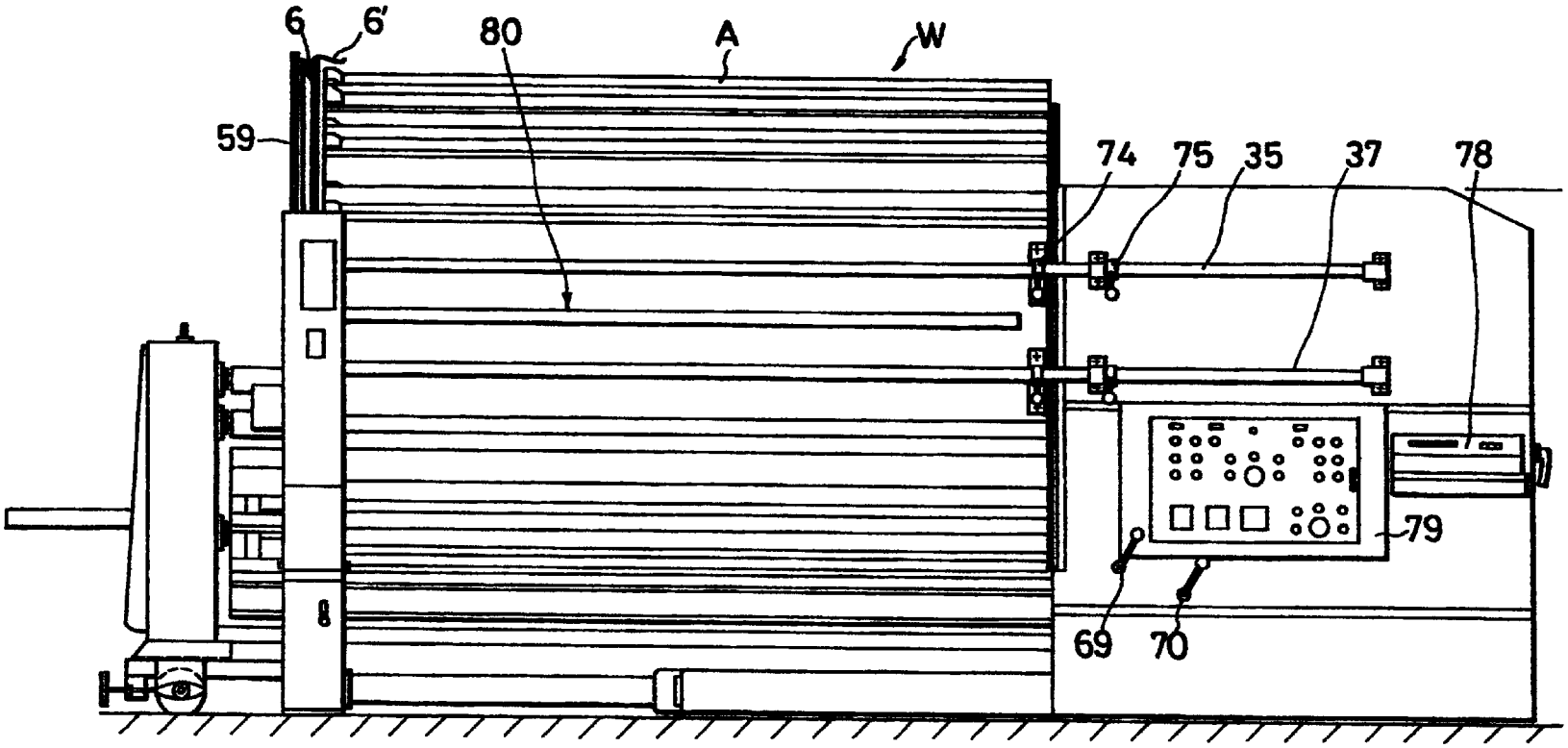
FIG. 4 is a side view of the sample warper.

A yarn selection guide unit 127 includes a plurality of yarn selection guides 127*a*–127*j* (FIG. 5) for selectively guiding the yarns 22 according to the instructions of a program setting unit 78 (FIG. 4). A slitted plate 28 generates pulses in response to the rotation of the pulley 4 to actuate a plurality of rotary solenoids 129 arrayed in correspondence to respective ones of the yarn selection guides 127*a*–127*j*. The yarn selection guides 127*a*–127*j* are attached one to each rotary solenoid 129. When the individual rotary solenoid 129 is energized, the corresponding yarn selection guide 127*a*–127*j* is moved angularly or turned to advance to its operating position (yarn exchange position); when the rotary solenoid 129 is de-energized, the yarn selection guide 127*a*–127*j* is reversely turned to return to its original standby position (yarn receiving position).

Figure 3:
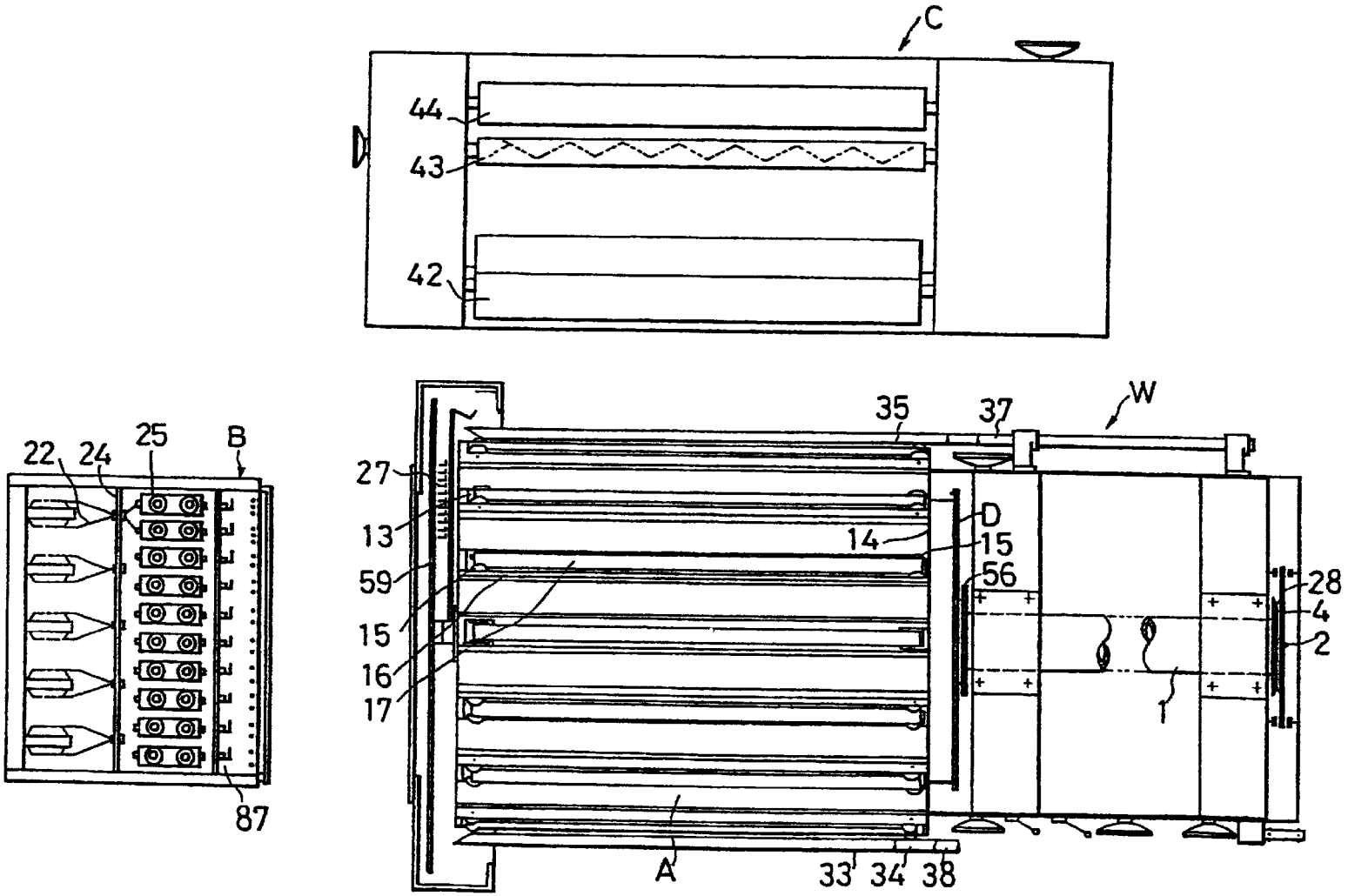
FIG. 3 is a plan view showing the arrangement of the sample warper, the fixed creel and the rewinder.

In FIG. 3 reference numerals 33, 34 and 38 designate shedding bars for jointly forming a shed of the yarns 22; two of the bars 33, 38 are upper shedding bars, and the remaining bar 34 is a lower shedding bar. Similarly, numeral 35 and 37 designate cut shedding bars for separating the shedding down yarns into lower-side yarns and upper-side yarns; one of the bars 35 is a cut shedding up bar, and the other bar 37 is a cut shedding down bar.

A yarn stop 39 (FIG. 2) is mounted on the drum frame 13 for stopping a yarn immediately under the broken yarn being shedded. The rewinder C is composed of a skeleton 40, a pair of rollers 41, 42, a zigzag-shaped comb 43, a roller 44 and a beam 45 for a woven fabric (FIG. 3).

Referring back to FIG. 1, a main motor 46 may be an inverter motor in order to enable acceleration and deceleration during operation of the warper, cushion start and stop, and jogging operation, thereby realizing a highly increased winding speed.

In FIG. 1, reference numeral 47 designates a main speed change pulley; 58, a V-belt wound on and between the main speed change pulley 47 and an auxiliary speed change pulley 48; 49, a counter pulley which is coaxial with the auxiliary speed change pulley 48; 50, a brake actuating pinion for reciprocatingly moving a rack to bring the rack into or out of engagement with a brake hole (not shown) in a brake drum D, thus regulating the rotational speed of the warper drum A as desired. Reference character 51 designates a belt moving motor (AC servo motor); 52, a shaft lever; 53, a driven gear; 54, a sprocket wheel; 55, a chain; 56, a chain wheel for driving the sun gear 18; 57 and 58, both V-belts; 59, a yarn introduction cover; and D, a brake drum.

A sensor 67 is provided for detecting the passing of a slit in the slitted plate 28.

The slitted plate 28 is designed so as to rotate in synchronism with the yarn introduction lever 6. The sensor 67 detects also the rotation of the yarn introduction lever 6 by detecting the rotation of the slit in the slitted plate 28. The number of the sensor 28 is three and these three sensors 67 are arranged at an angular space of about 120 degrees.

In FIG. 4, numeral 69 designates a movement/stopping changeover lever for changing over the movement/stopping of the conveyor belt 17; 70, a locking lever for locking the warper drum A; 74, a shedding bar adjusting lever; 75, a shedding bar locking handle; 78, a program setting unit; 79, a controller; and 80, a yarn tensioning unit located centrally on the straight part 12 of the warper drum A.

Figure 6:
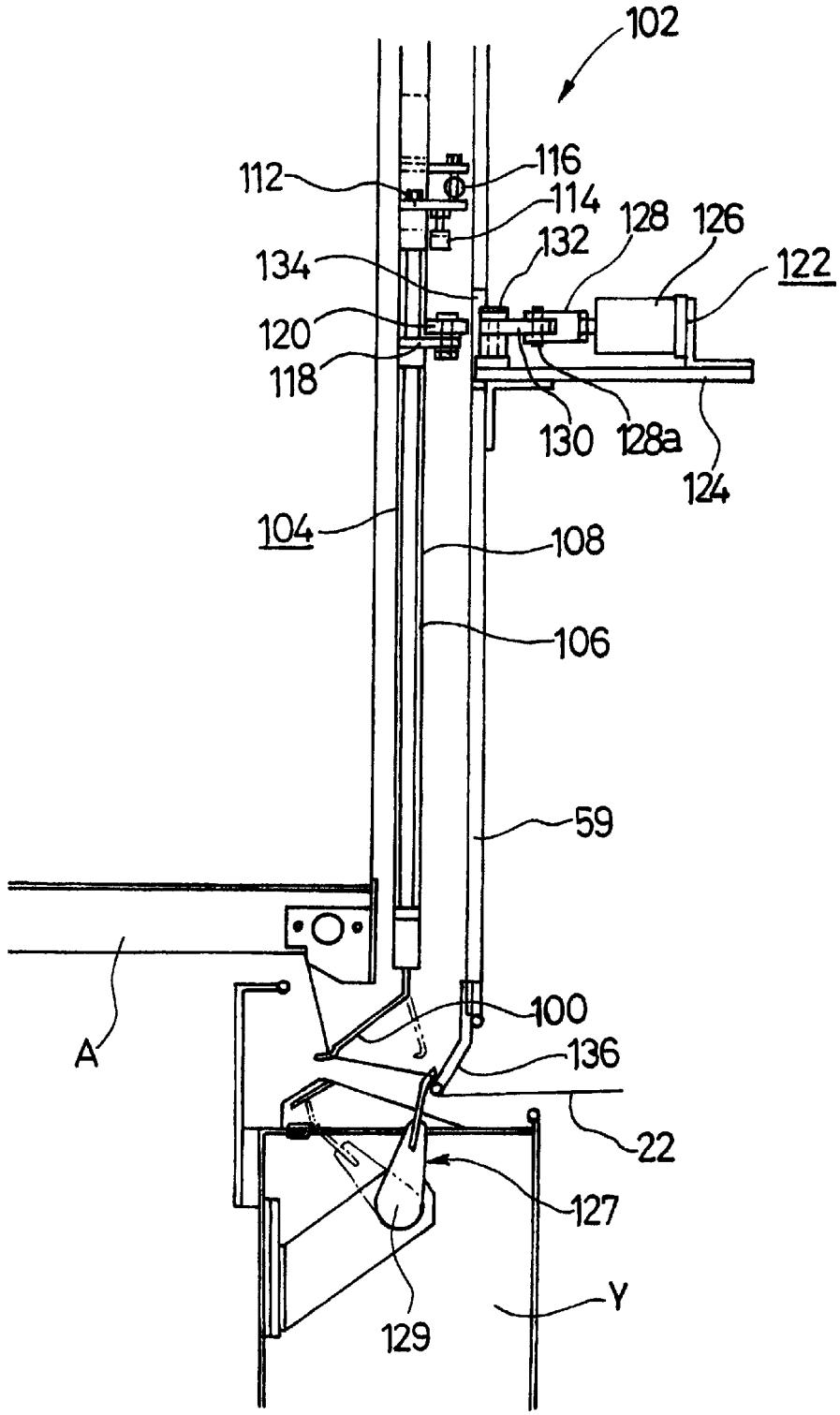
FIG. 6 is a diagrammatical side view showing a yarn exchange unit according to the present invention.
Figure 7:
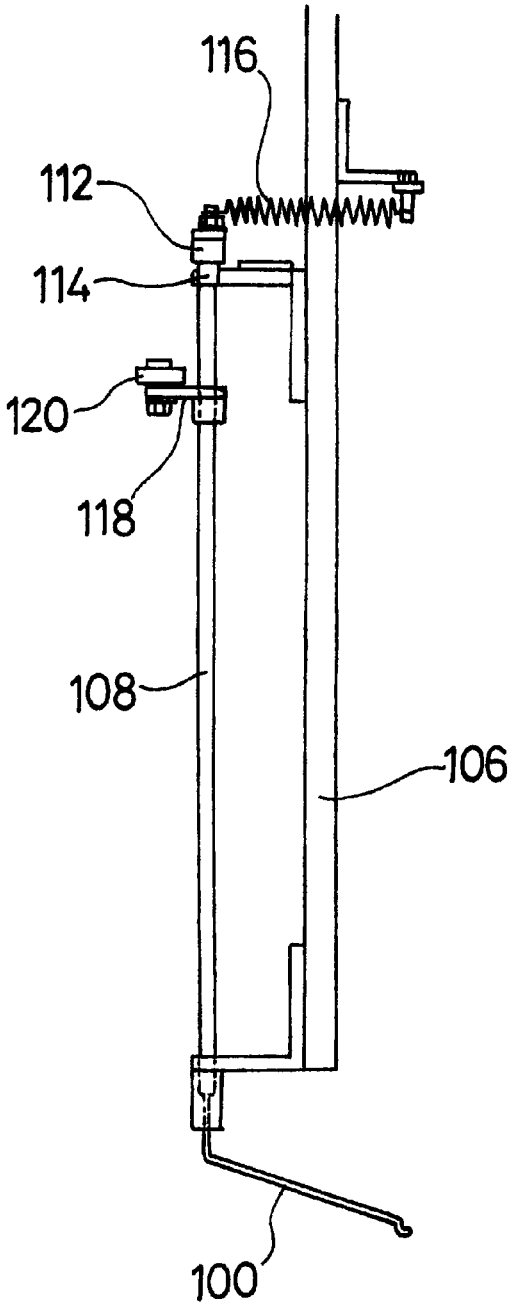
FIG. 7 is a diagrammatical front elevational view showing the distal end portion of a yarn introduction lever according to the present invention.

Now description will be given of a novel yarn exchange mechanism according to the present invention. The yarn exchange mechanism, as shown in FIGS. 6 through 8, generally comprises a yarn introduction member actuating unit 102 for actuating a yarn introduction member 100 to catch or release a yarn 22, and the aforesaid yarn selection guide unit 127 including the plural yarn selection guides 127*a*–127*j* operative to catch the yarn released from the yarn introduction member 100 or enable the yarn introduction member 100 to hook or catch a yarn.

Figure 8:
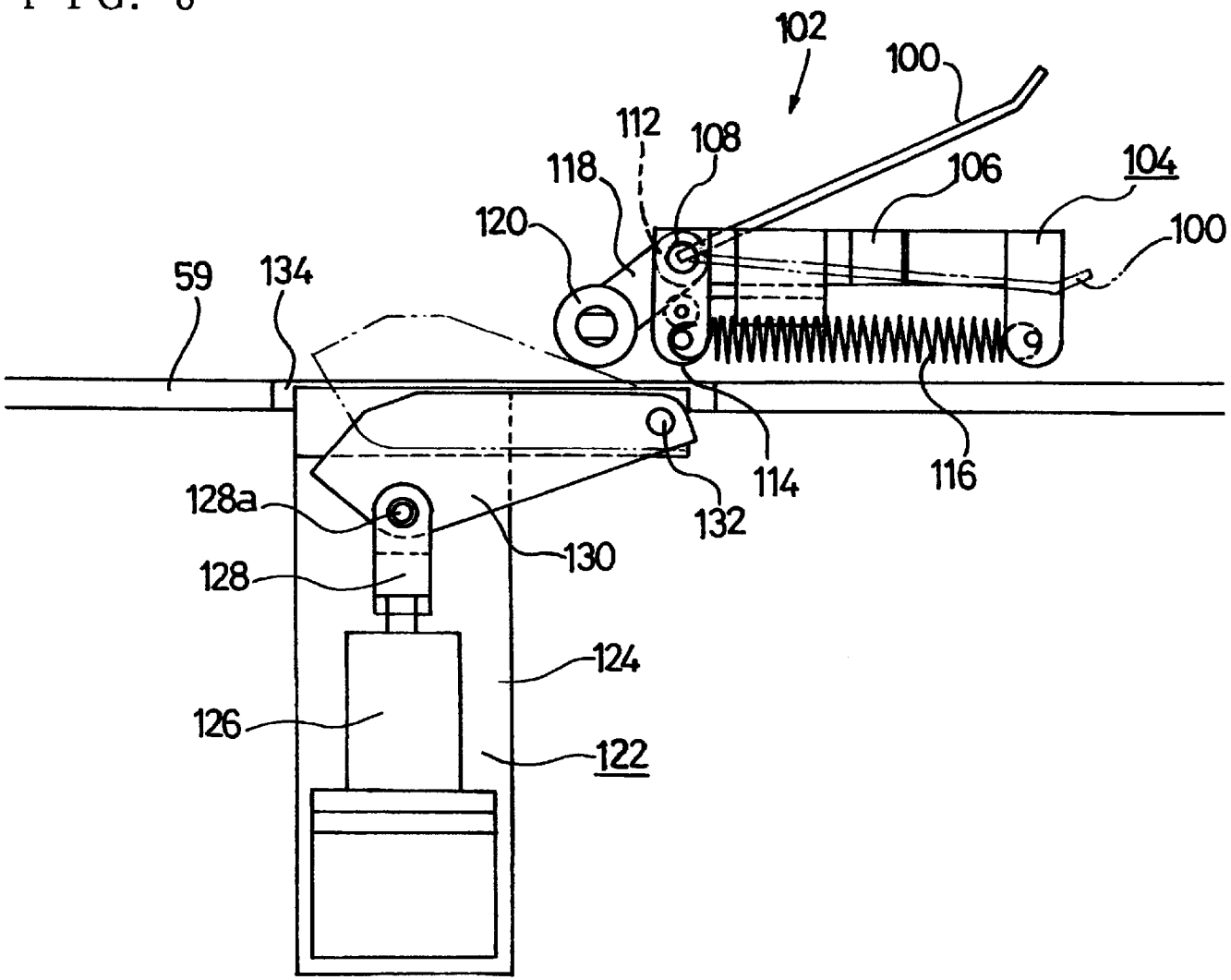
FIG. 8 is a top plan view showing a yarn introduction member actuating unit according to the present invention.

The yarn introduction member actuating unit 102 is composed of a yarn introduction member assembly 104 including the yarn introduction member which is movable, and a yarn introduction member actuator unit body 122 (FIG. 8). The number of the yarn introduction member assembly 104 is one or plural, while the number of the yarn introduction member actuator unit body 122 is plural and corresponds to the number of the yarn selection guides 127*a*–127*j*.

The yarn introduction member assembly 104 includes a yarn introduction lever 106 rotatably mounted interiorly of the yarn introduction cover 59, and a rotary holder 108 rotatably mounted on a distal end (fore end) portion of the yarn introduction lever 106 The yarn introduction member 100 is attached to a distal end (fore end) of the rotary holder 108.

The proximal end (base) portion of the rotary holder 108 is attached to a pin plate 112 to which is connected a stopper 114 for positioning the yarn introduction member 100. The pin plate 112 is connected to a spring means 116 and by this spring means 116 the yarn introduction member 100 is held in a warping position.

The rotary holder 108 has a plate 118 attached thereto for angularly moving or turning the yarn introduction member 100, and a bearing 120 attached to the plate 118.

The yarn introduction member actuating unit bodies 122 are mounted on a central portion of the outside surface of the yarn introduction cover 59 at a position corresponding to the attaching position of the bearing 120. Each of the yarn introduction member actuating unit bodies 122 has an air cylinder mounting member or bracket 124 attached to the outside surface of the yarn introduction cover 59, and an air cylinder 126 supported on the air cylinder mounting bracket 124.

As shown in FIG. 8, the air cylinder 126 has a piston rod connected at its outer end (fore end) to a joint member 128. Designated by 130 is a dog member having one end connected by a pin 128*a* to the joint member 128. The other end of the dog member 130 is rotatably connected by a pin 132 to the air cylinder mounting bracket 124.

Figure 5:
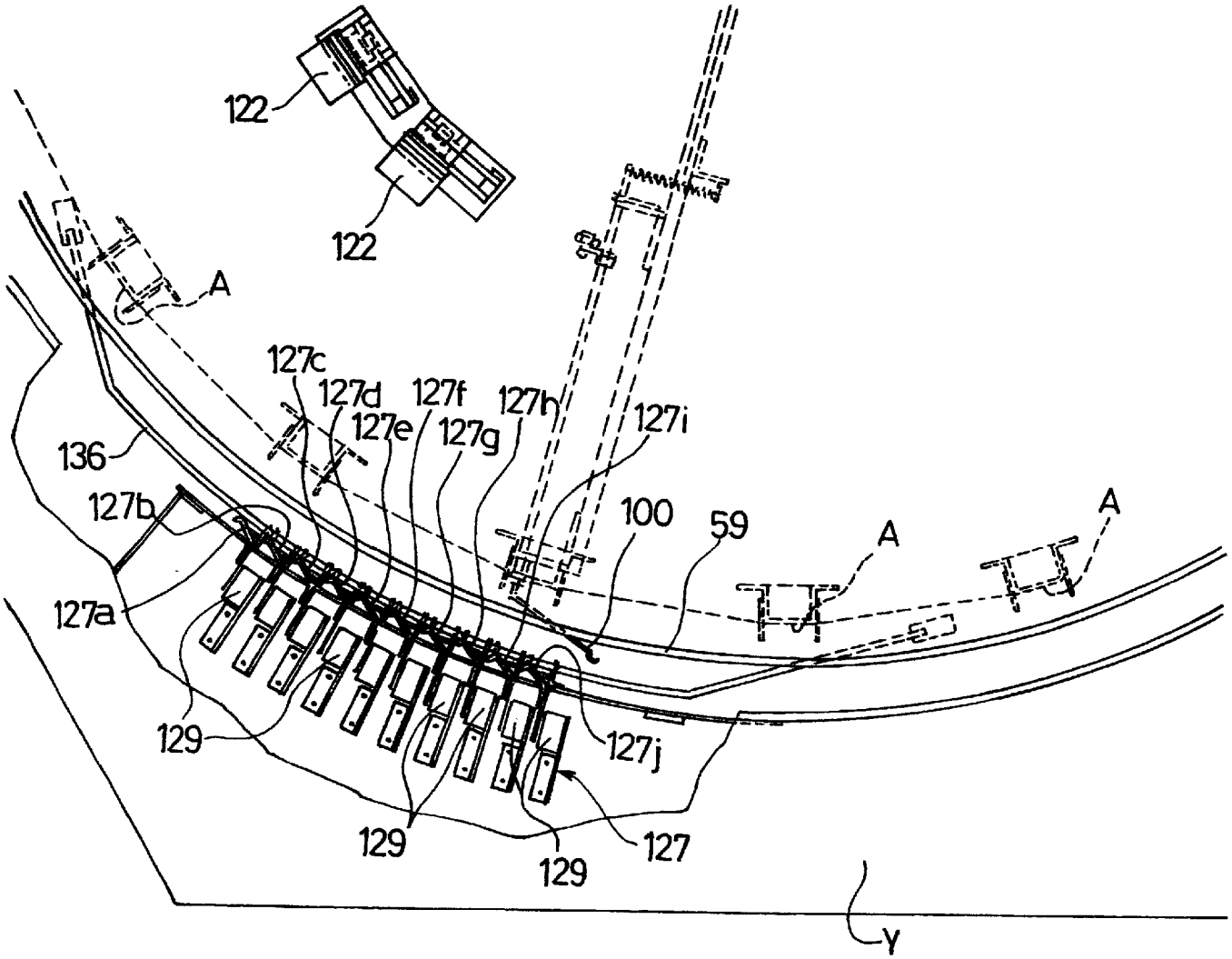
FIG. 5 is a detailed front elevational view, with parts broken away, of a yarn selection guide unit of the sample warper.

The yarn introduction cover 59 has an opening 134 through which the dog member 130 is movable to project from and retract into the yarn introduction cover 59. When the dog member 130 is forced against the bearing 120, the rotary holder 108 and the yarn introduction member 100 are turned about an axis of the rotary holder 108. As shown in FIGS. 5 and 6, a guide bar 136 is attached to a lower end portion of the yarn introduction cover 59 for guiding the yarn 22.

As described above, the yarn selection guide unit 127 has a plurality of yarn selection guides 127*a*–127*j*, and each of the yarn selection guides 127*a*–127*j* is angularly moved or turned by a corresponding one of the rotary solenoids 129 between an operating position (yarn exchange position) and a standby position (yarn receiving position). The yarn selection guide unit 127 has the same operating mechanism as the conventional yarn selection guide unit.

Figure 9:
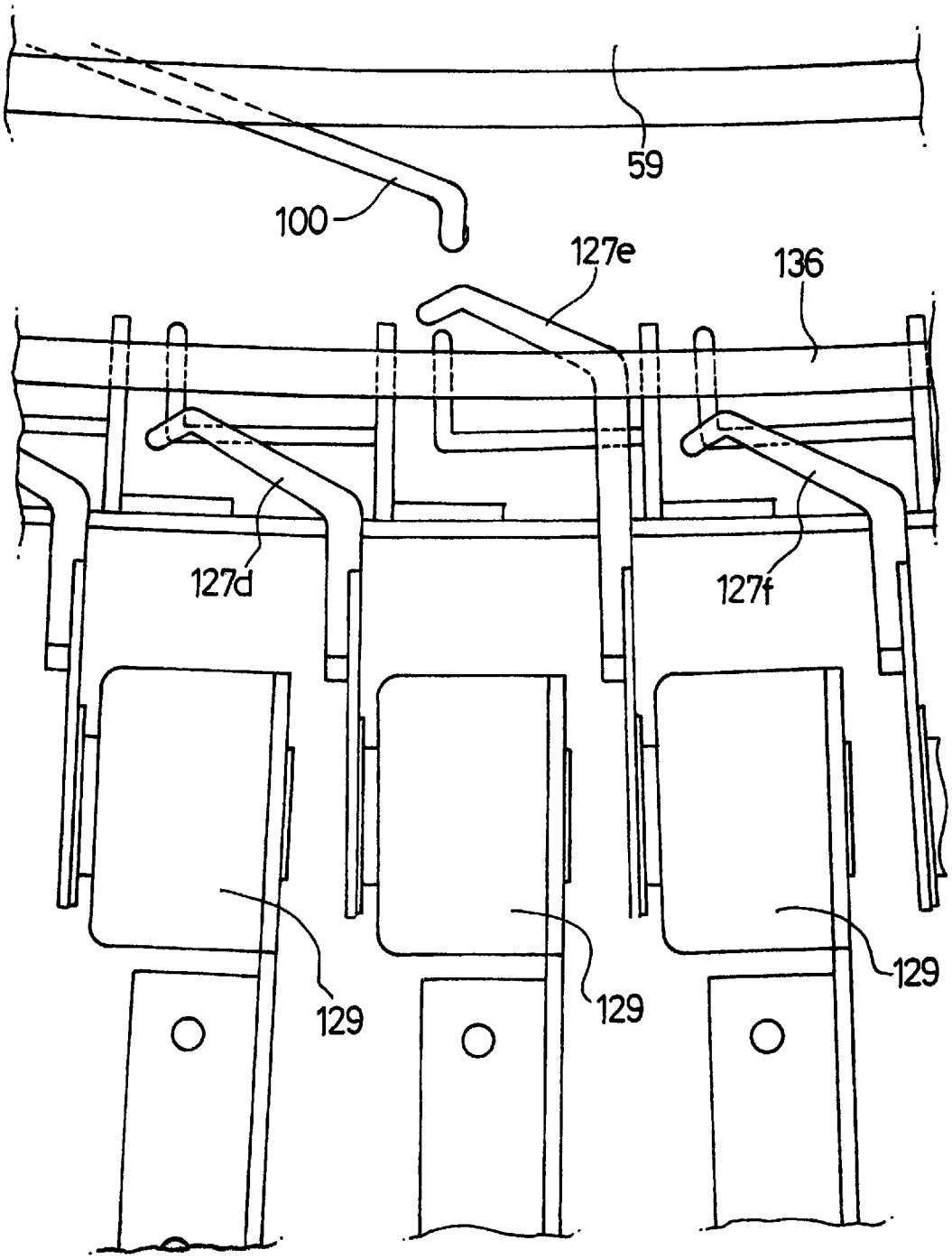
FIG. 9 is a diagrammatical view showing the relationship between the yarn selection guide unit and a yarn introduction member according to the present invention.
Figure 10:
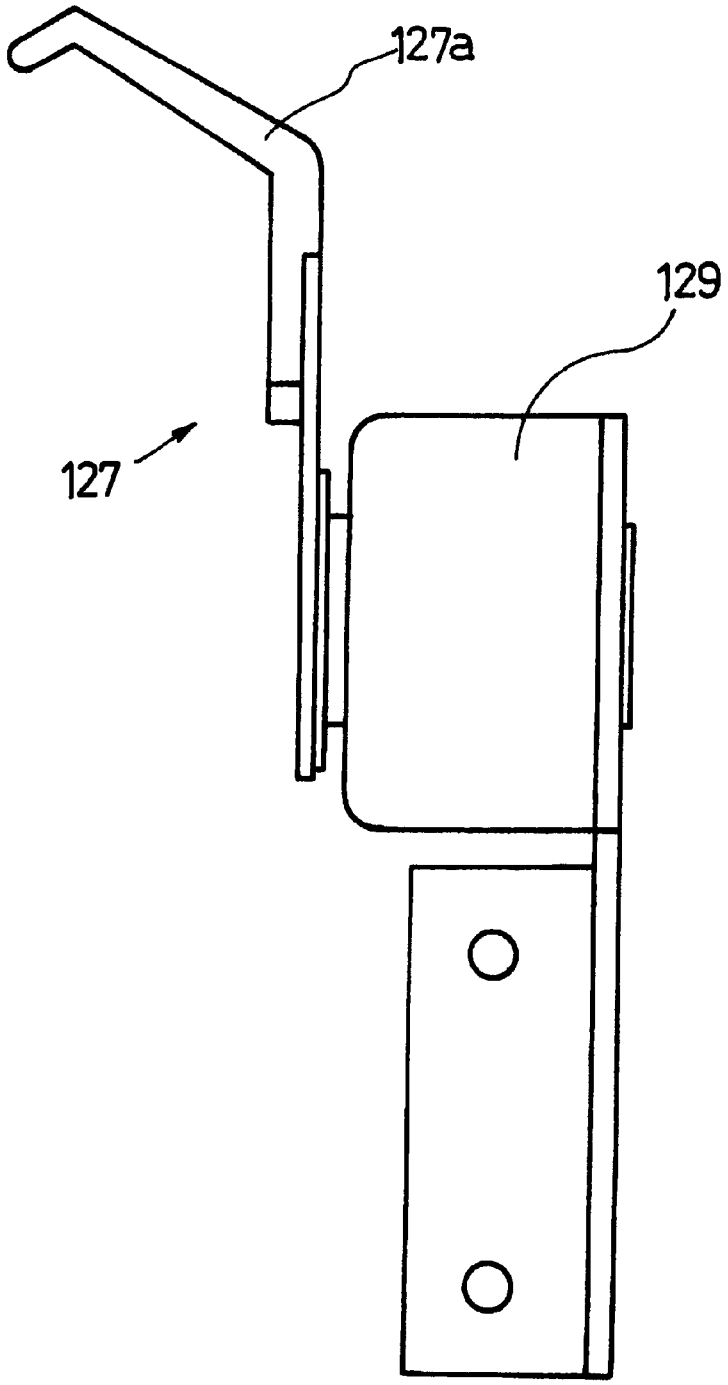
FIG. 10 is a side view showing one yarn selection guide of the present invention.

As shown in FIGS. 9 and 10, the yarn selection guides 127*a*–127*j* each have a distal end portion bent in the same direction as the direction of angular movement of the yarn introduction member 100, so that even when any one (127*d*–127*f* shown in FIG. 9, or 127*a* shown in FIG. 10, for example) of the yarn selection guides 127*a*–127*j* is turned to the yarn exchange position, the yarn 22 introduced by the yarn introduction member 100 is able to pass the yarn selection guides 127*d*–127*f* (FIG. 9) while sliding on the yarn selection guide 127*e*. The yarn 22 is thus protected from being accidentally caught by the yarn selection guide 127*e*.

Figure 25:
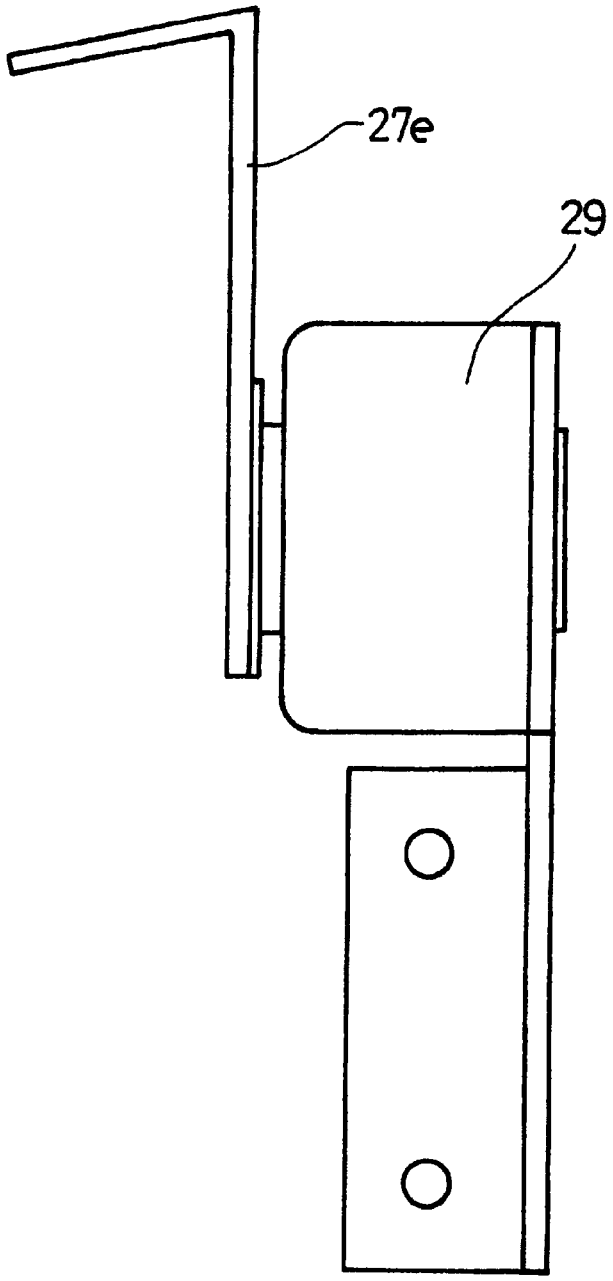
FIG. 25 is a side view showing one conventional yarn selection guide.
Figure 26:
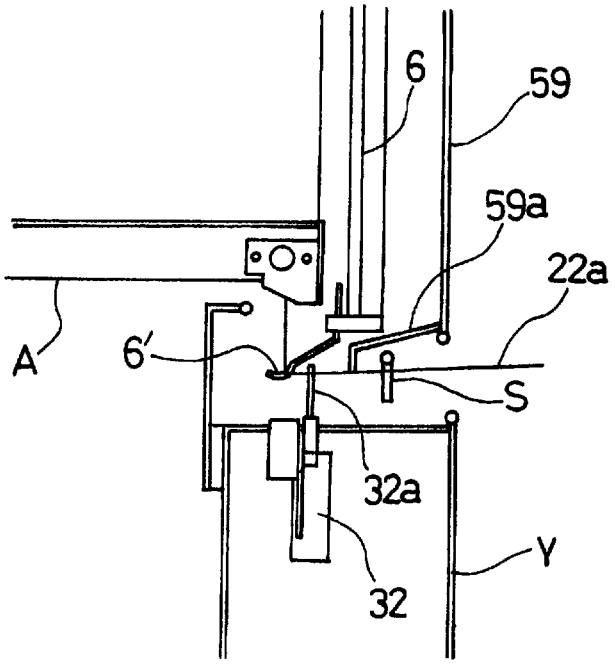
FIG. 26 is a diagrammatical view showing a first step of operation of a conventional yarn exchange mechanism in which a yarn held on the yarn introduction lever is being removed by a yarn remover.
Figure 27:
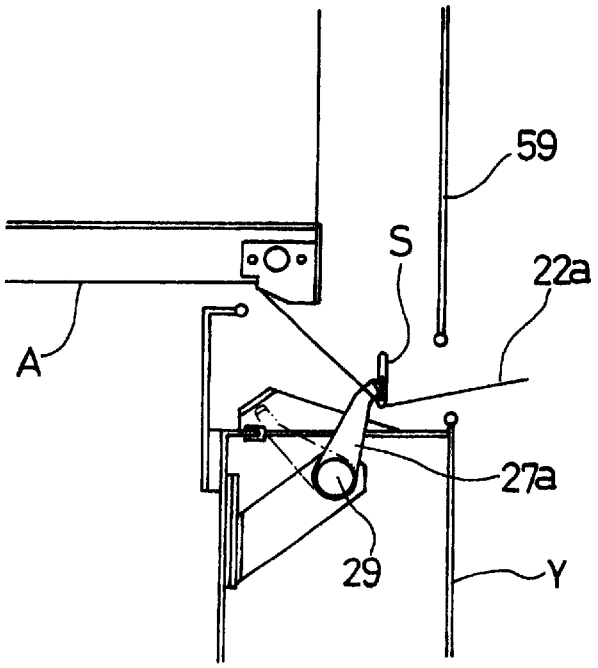
FIG. 27 is a diagrammatical view showing a second step of operation of the conventional yarn exchange mechanism in which the yarn released from the yarn introduction lever is caught by a yarn selection guide which has been turned to a yarn exchange position.
Figure 28:
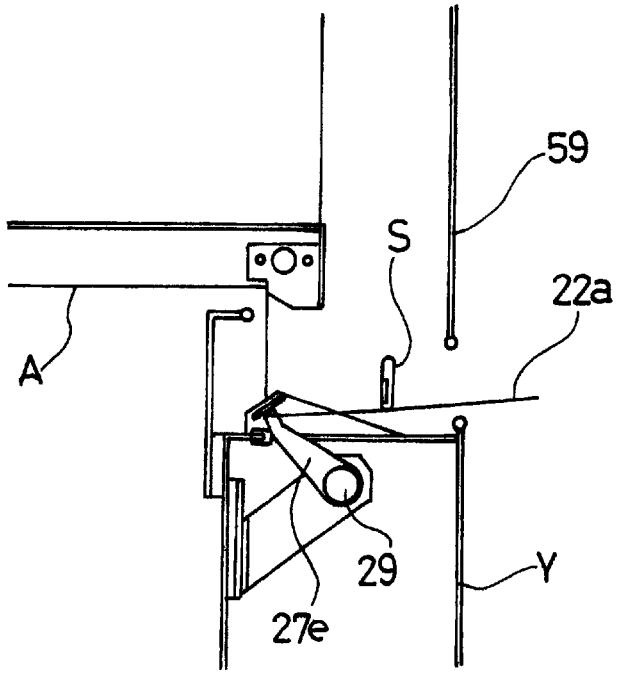
FIG. 28 is a diagrammatical view showing a third step of operation of the conventional yarn exchange mechanism in which the yarn selection guide is turned to its retracted standby position with the yarn held thereon.
Figure 29:
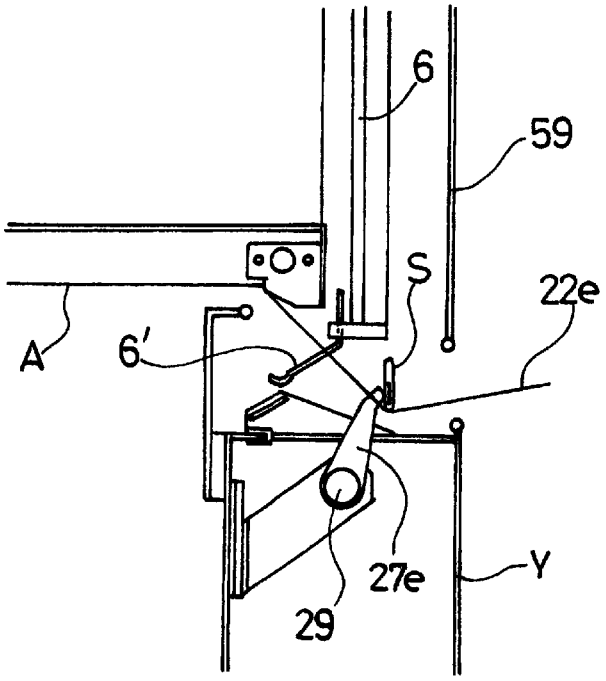
FIG. 29 is a diagrammatical view showing a fourth step of operation of the conventional yarn exchange mechanism in which another yarn selection guide has reached the yarn exchange position with a different yarn held thereon.
Figure 30:
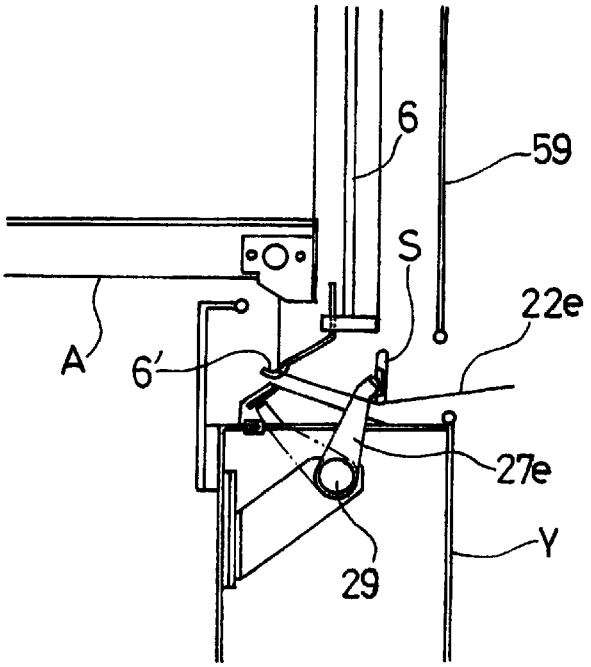
FIG. 30 is a diagrammatical view showing a fifth step of operation of the yarn exchange mechanism in which while keeping the condition shown in FIG. 29, the yarn introduction lever has passed the yarn exchange position to catch the different yarn.
Figure 31:
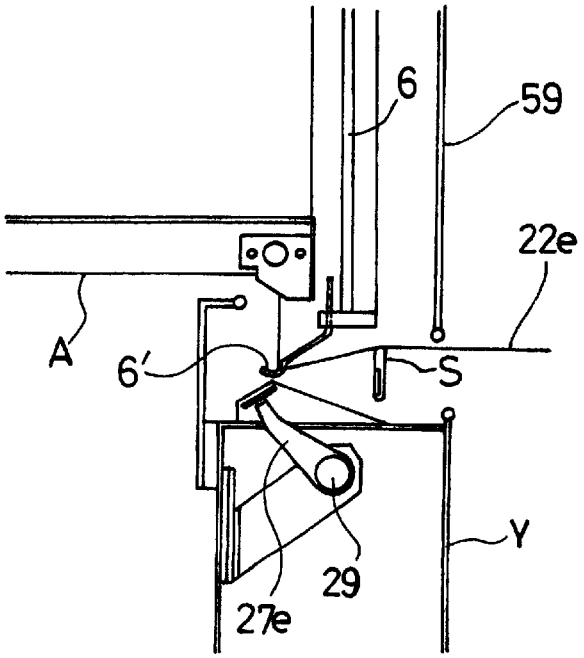
FIG. 31 is a diagrammatical view showing a sixth step of operation of the conventional yarn exchange mechanism in which the different yarn is being wound on the warper drum with the yarn selection guide retracted to the standby position.

By contrast, in the case of the conventional yarn selection guides 27*a*–27*j* (only one guide 27*e* shown in FIG. 25) having a simple upstanding configuration, if each yarn selection guide 27*a*–27*j* is disposed in the yarn exchange position, the yarn 22 will be caught by the yarn selection guide 27*a*–27*j*, failing to pass the yarn selection guides 27*a*–27*j*. To deal with this problem, turning of each of the conventional yarn selection guides 27*a*–27*j* to the yarn exchange position must be retarded until after the passage of the yarn 22 through the yarn selection guides 27*a*–27*j* has been confirmed.

In the case of the yarn selection guides 127*a*–127*j* of the present invention, even when any of the yarn selection guides 127*a*–127*j* is turned to the yarn exchange position before the yarn 22 reaches the yarn selection guide 127*a*–127*j*, the yarn 22 is able to pass the yarn selection guide 127*a*–127*j* while sliding on the same. It is, therefore, possible to place a desired yarn selection guide in the yarn exchange position before the passage of the yarn through the yarn exchange position.

Figure 11:
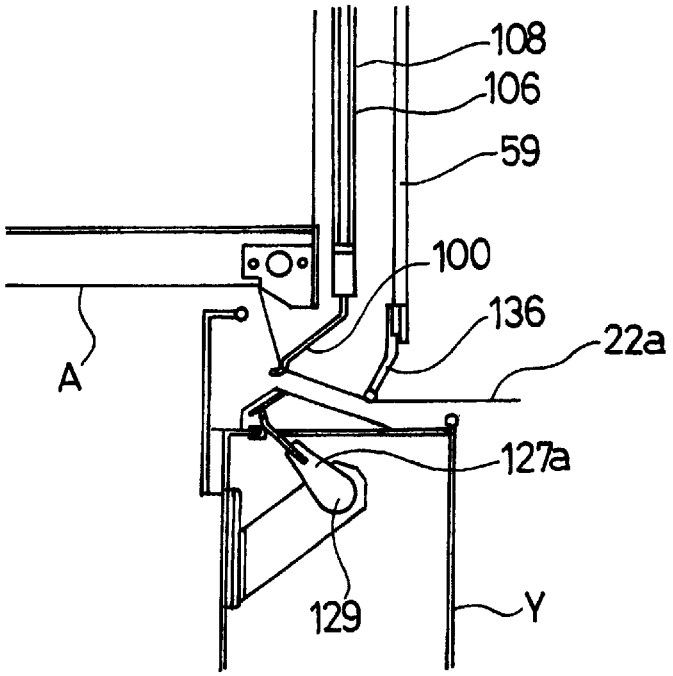
FIG. 11 is a diagrammatical view illustrative of the manner in which a yarn is being wound on a warper drum by the yarn introduction member of the present invention.

Operation of the foregoing arrangement performed to change a yarn 27 on the yarn selection guide 27*a* to a yarn 27*e* on the yarn selection guide 27*e* will be described below with reference to FIGS. 11 through 19. At first, the yarn 22*a* is wound on the warper drum A during which time, the yarn 22*a* continuously supplied from the creel B first passes between the base Y and the guide bar 136, then is held by the yarn introducing member 100, and thereafter is wound on the warper drum A (FIG. 11).

Figure 12:
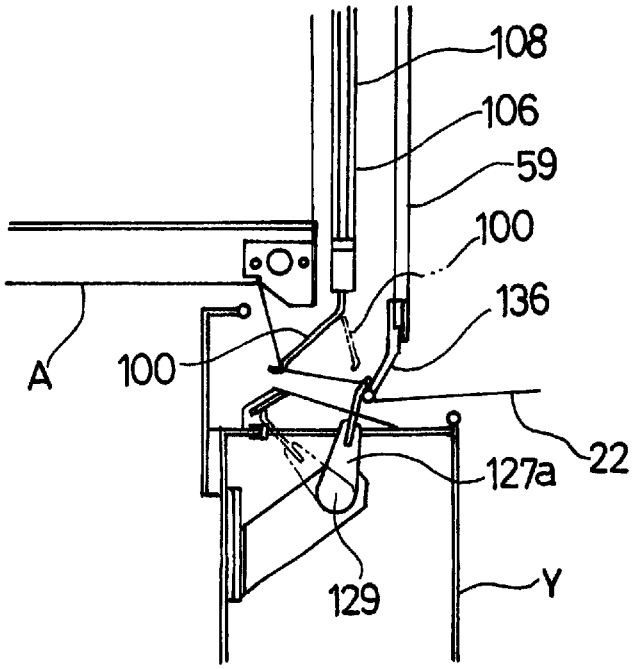
FIG. 12 is a diagrammatical view showing a first step of operation of the yarn exchange mechanism, in which a yarn held on the yarn introduction member is passing a yarn selection guide while being disposed in its yarn exchange position.

When yarn exchange is needed, the yarn selection guide 127*a* adapted to receive thereon the yarn 22*a* being wound is angularly moved or turned toward the guide bar 136, and the air cylinder 126 of one yarn introduction member actuating unit body 122 which is corresponding to the yarn selection guide 127*a* is activated to move the dog member 130 to its operating position in preparation for the yarn change (FIG. 12).

Figure 13:
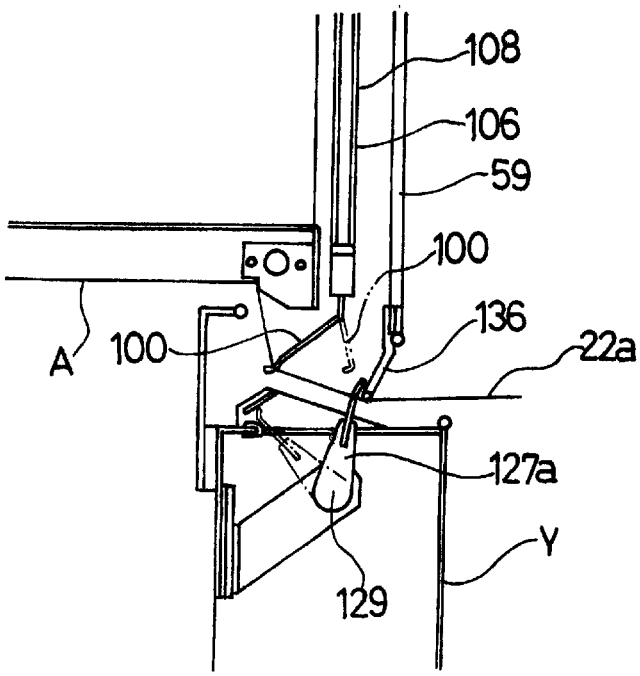
FIG. 13 is a diagrammatical view showing a second step of operation of the yarn exchange mechanism, in which the yarn held on the yarn introduction member has passed the yarn selection guide.
Figure 14:
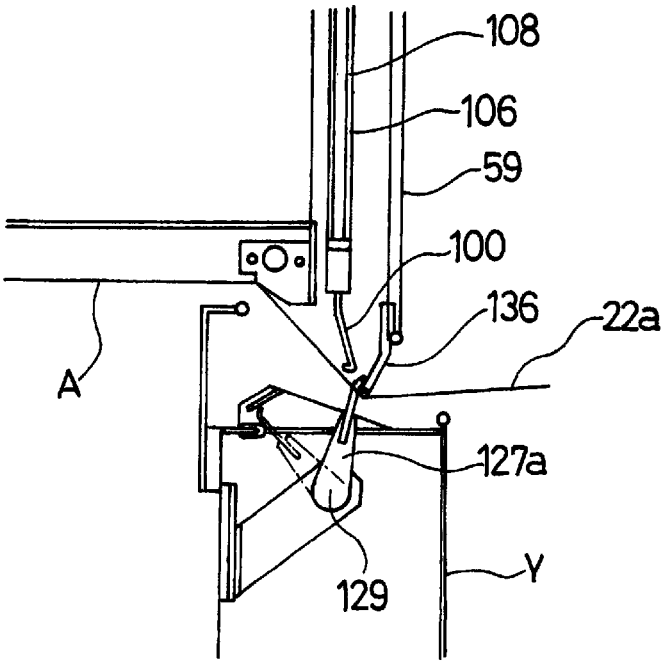
FIG. 14 is a diagrammatical view showing a third step of operation of the yarn exchange mechanism, in which the yarn introduction member is turned reversely to allow the yarn to be caught by the yarn selection guide.

The yarn 22*a* supplied from the creel B passes between the base Y and the guide bar 136 and between the base Y and the yarn selection guide 127*a* while it is being held by the yarn introduction member 100 (FIG. 13). As the yarn introduction lever 106 further rotates, the bearing 120 mounted on the plate 118 used for turning the yarn introduction member 100 is brought into rolling contact with the dog member 130 (FIG. 8), whereupon the yarn introduction member 100 starts turning in a direction to release the yarn 22*a*. With this angular movement of the yarn introduction member 100, the yarn 22*a* is released from the yarn introduction member 100, and the released yarn 22*a* is pulled backward between the guide bar 136 and the base Y until it strikes on the yarn selection guide 127*a* which in turn catches the released yarn 22*a* (FIG. 14).

Figure 15:
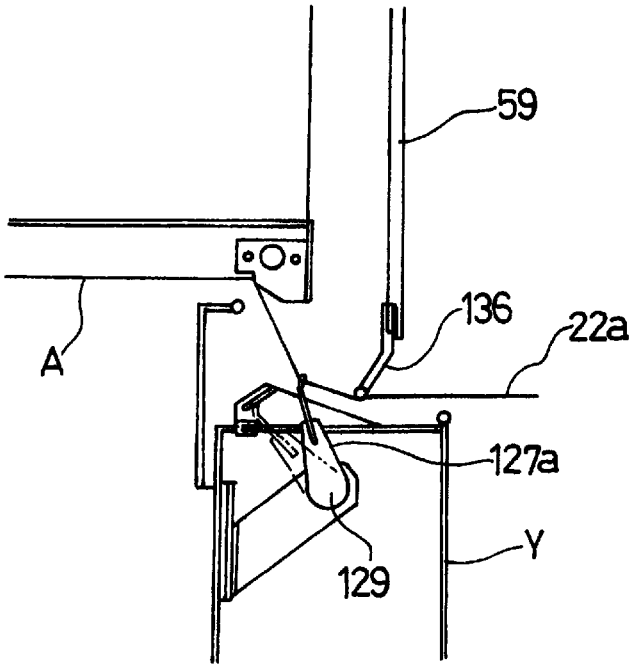
FIG. 15 is a diagrammatical view showing a fourth step of operation of the yarn exchange mechanism, in which the yarn selection guide is turned to return to its standby position with the yarn held thereon.
Figure 16:
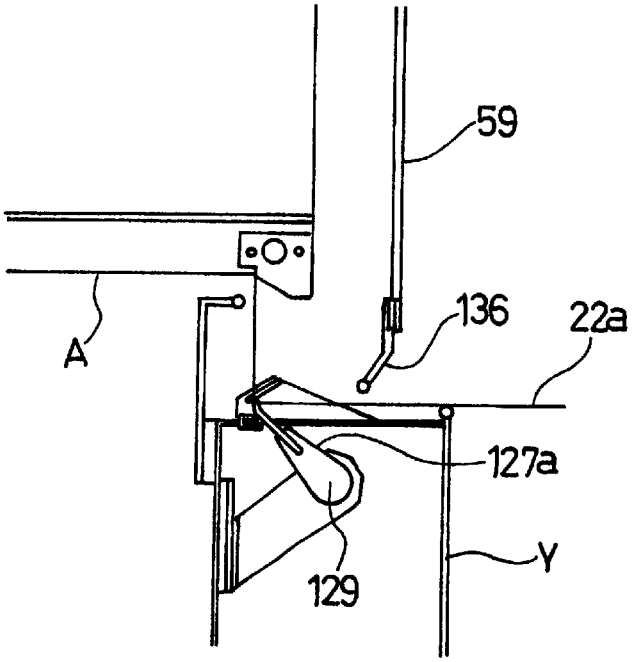
FIG. 16 is a diagrammatical view showing a fifth step of operation of the yarn exchange mechanism, in which the yarn selection guide has just reached the standby position with the yarn held thereon.

Then, the yarn selection guide 127*a* is reversely turned to move from its advanced operating position close to the guide bar 136 to its retracted standby position close to the base Y (FIG. 15). With this angular movement of the yarn selection guide 127*a*, the released yarn 22*a* while being held on the yarn selection guide 127*a* is received in the base Y side (FIG. 16).

When the yarn introduction lever 106 has passed the yarn release position, the air cylinder 126 of the yarn introduction member actuating unit body 122 is de-activated to move the dog member 130 from the advanced operating position (indicated by the phantom lines shown in FIG. 8) to the retracted standby position (indicated by the solid lines shown in FIG. 8), allowing the yarn introduction member 100 to turn reversely to return to its original warping position by the force of the spring 116.

Figure 17:
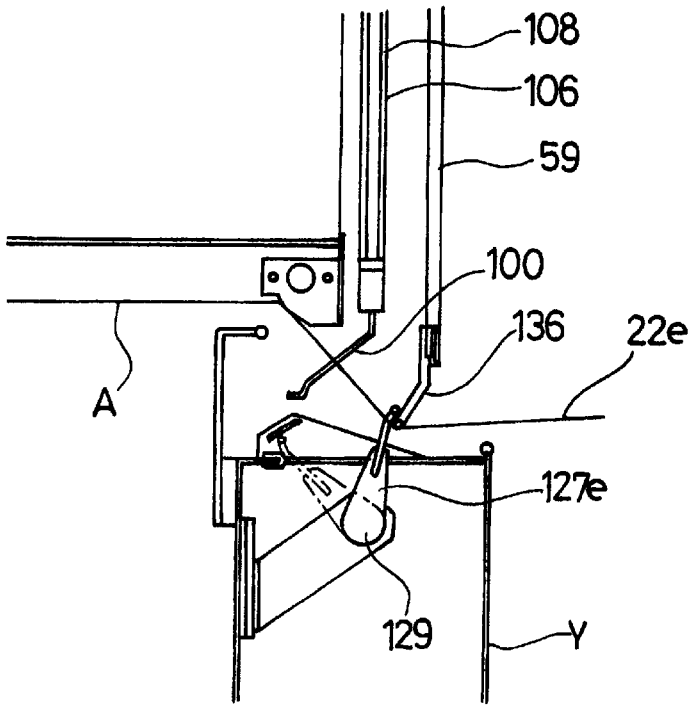
FIG. 17 is a diagrammatical view showing a sixth step of operation of the yarn exchange mechanism, in which a yarn selection guide holding thereon a different yarn has turned to the yarn exchange position.
Figure 18:
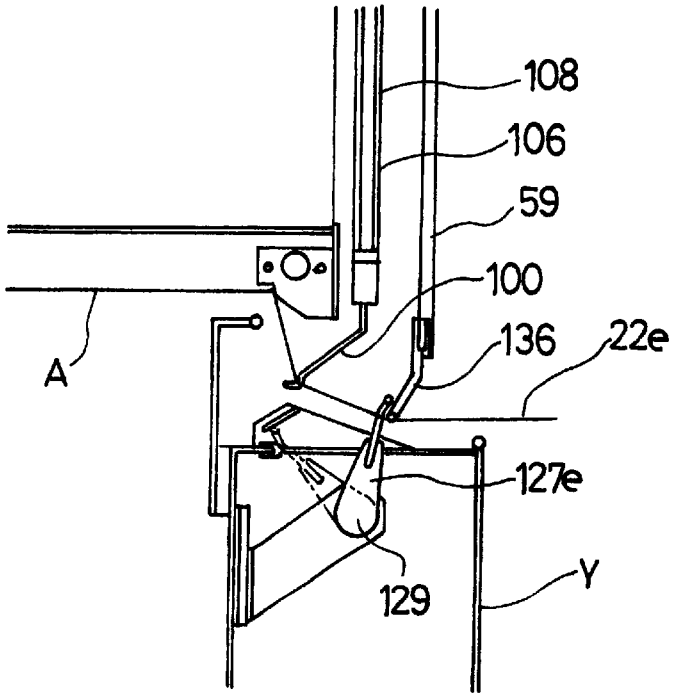
FIG. 18 is a diagrammatical view showing a seventh step of operation of the yarn exchange mechanism, in which the hold of the different yarn is changed from the yarn selection guide to the yarn introduction member.
Figure 19:
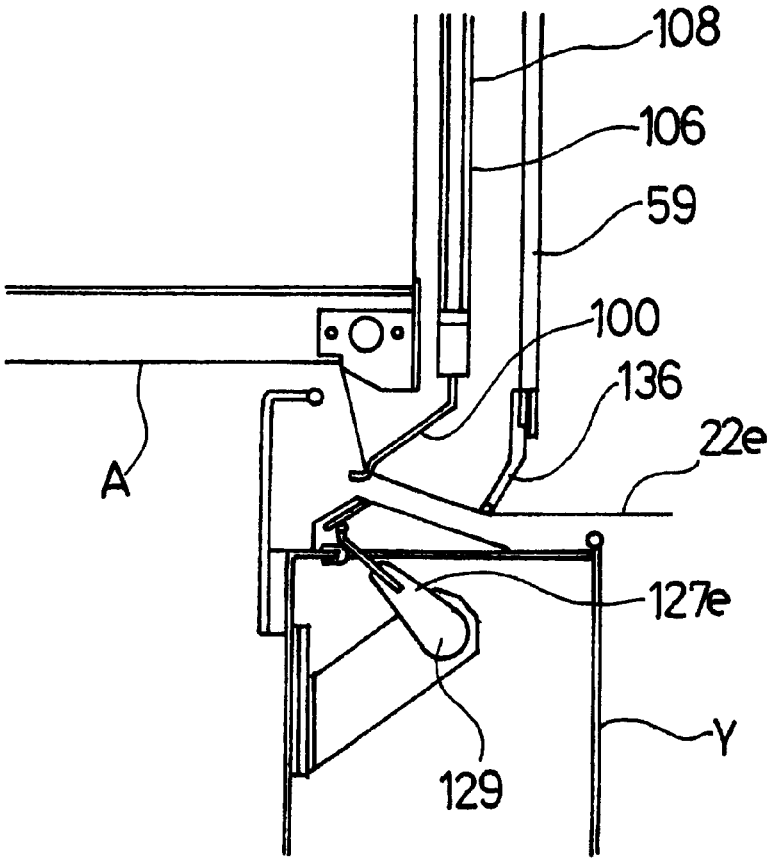
FIG. 19 is a diagrammatical view showing an eighth step of operation of the yarn exchange mechanism, in which the yarn selection guide is returned to its standby position after releasing the different yarn, while the different yarn is being wound on the warper drum by the yarn introduction member.

Then, the yarn selection guide 127*e* holding thereon the yarn 27*e* to be wound next is turned from the base Y side (standby position) toward the guide bar 136 side (operating position) so that the yarn 22 held on the yarn selection guide 127*e* is disposed in the yarn exchange position (FIG. 17). Subsequently, the yarn introduction member 100 while being held in the warping position passes the yarn exchange position in which instance the yarn 27*e* is caught by the yarn introduction member 100 (FIG. 18). The yarn 27*e* while being held on the yarn introduction member 100 is wound on the warping drum A. The yarn selection guide 127*e* now free from the yarn 27*e* is angularly moved to return to its standby position (FIG. 19).

The yarn exchange mechanism of the present invention should by no means be limited to the foregoing embodiment but may include another form of the embodiment, as will be described below with reference to FIGS. 20 and 21. In the embodiment shown in FIGS. 20 and 21, these parts which are like or corresponding to FIGS. 1–19 are designated by the same reference characters.

Figure 20:
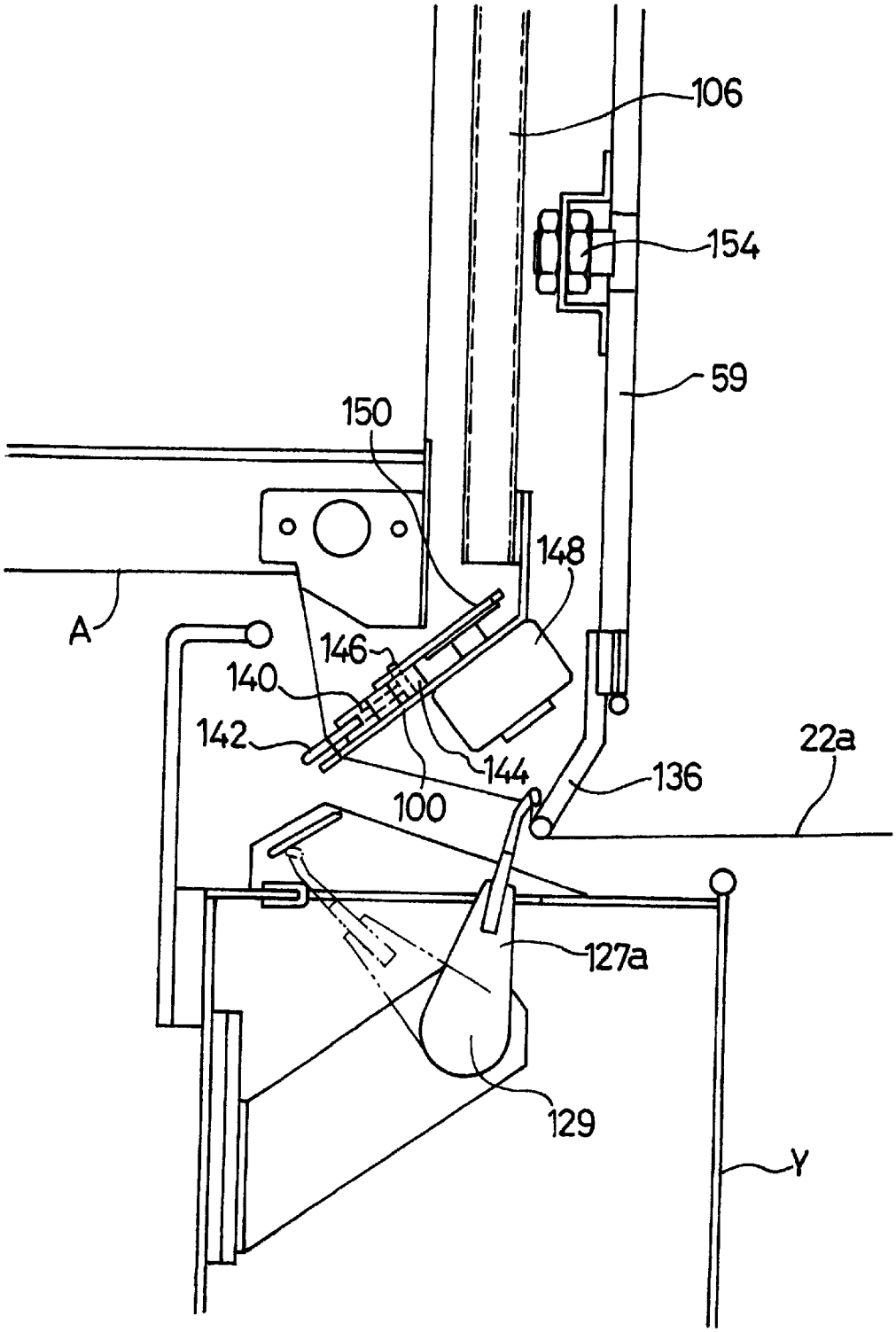
FIG. 20 is a diagrammatical view similar to FIG. 12, but showing another form of a yarn holding mechanism taken by the yarn introduction member according to the present invention.
Figure 21:
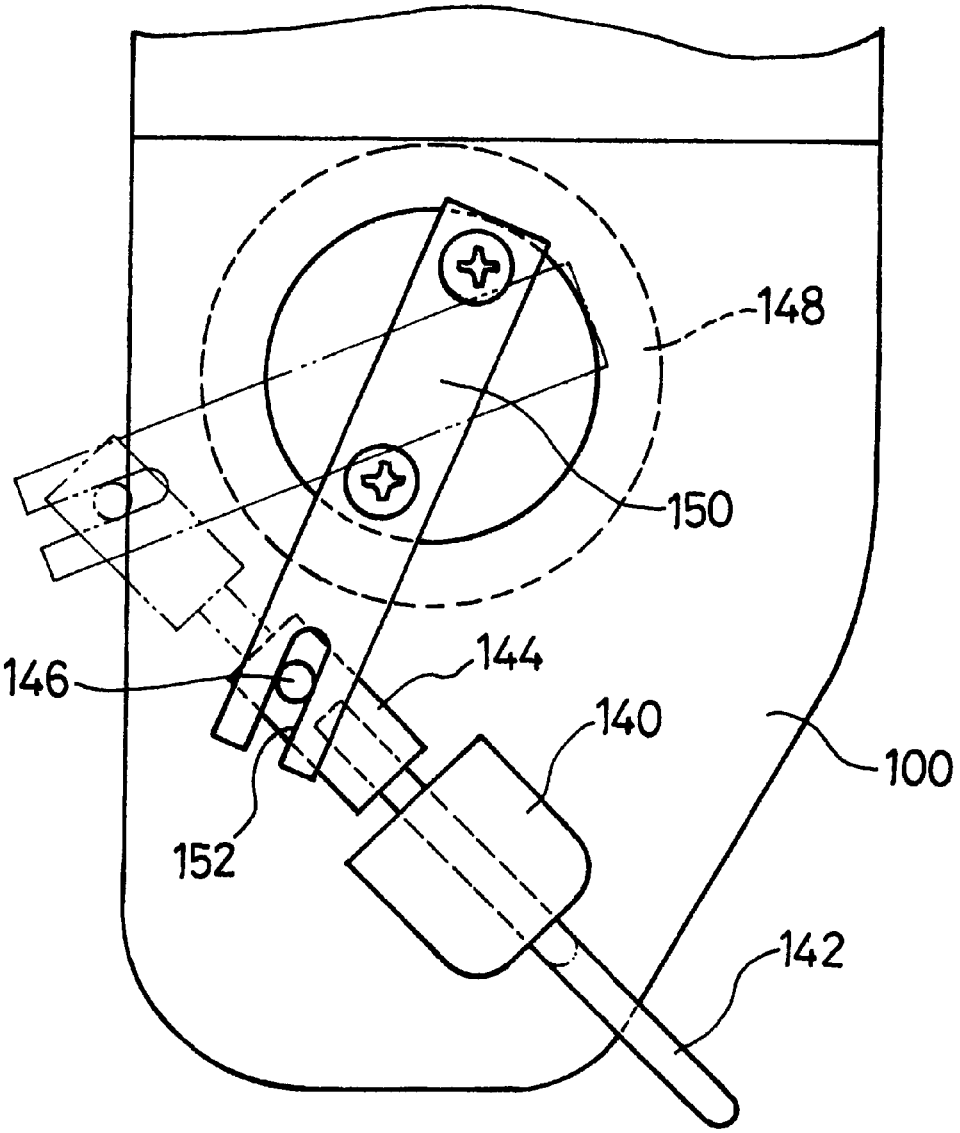
FIG. 21 is a detailed top plan view of the yarn holding mechanism formed by the yarn introduction member shown in FIG. 20.

As shown in FIGS. 20 and 21, a yarn introduction member 100 is attached to a yarn introduction lever 106 (FIG. 20). The yarn introduction member 100 has a support member 140 attached thereto. A yarn holding member 142 is slidably mounted on the support member 140 and movable back and forth.

The yarn holding member 142 has one end (proximal end) fixed to a block 144. The block 144 has a pin 146 attached thereto. Designated by 148 is a rotary solenoid mounted on the yarn introduction member 100. The rotary solenoid 148 has an output shaft firmly connected to one end of an arm 150. The opposite end (distal end) of the arm 150 has an engagement groove or recess 152 (FIG. 21) in which the pin 144 is fittedly received.

Designated by 154 shown in FIG. 20 is one of a plurality of sensors disposed at an appropriate position on the yarn introduction cover 59 for detecting the position of the yarn introduction lever 106. Each of the sensors 154 is provided in correspondence with a corresponding one of the yarn selection guides 127*a*–127*j*.

When a yarn change operation is to be performed, one 127*a* of the yarn selection guides holding thereon the yarn being wound such as the yarn 22*a* is driven to move toward the guide bar 136. Then, after the yarn introduction lever 106 passes the position of the yarn selection guide 127*a*, the sensor 154 corresponding to the yarn selection guide 127*a* detects the yarn introduction lever 106 and upon detection it generates a signal to activate the rotary solenoid 148.

When the rotary solenoid 148 is activated, the yarn holding member 142 is pulled inwardly of the yarn introduction member 100 by virtue of angular movement of the arm 150, as indicated by the phantom lines shown in FIG. 21. As the yarn holding member 142 is pulled inwardly of the yarn introduction member 100, the yarn 22*a* held jointly by the yarn introduction member 100 and the yarn holding member 142 is allowed to slide on the yarn introduction member 100 and then detached or released from the yarn introduction member 100.

The released yarn 22*a* is allowed to return between the guide bar 136 and the base Y and abuts against the yarn selection guide 127*a*. Then the yarn selection guide 127*a* is angularly moved from the guide bar 136 side toward the base Y side during that time the released yarn 22*a* is stored on the base Y side while it is held on the yarn selection guide 127. The rotary solenoid 148, after the lapse of a predetermined time, is returned to its original position with the result that the yarn holding member 142 is forced to slide outwardly of the yarn introduction member 100 to the solid-lined advanced position shown in FIG. 21.

Then, another yarn selection guide (127*e*, for example) holding thereon a yarn (27*e*, for example) to be wound next is angularly moved from the base Y side toward the guide bar 136 side whereupon the yarn 27*e* stored on the base Y is released from the yarn selection guide 127*e*. Subsequently, as the yarn introduction member 100 passes the position of the yarn selection guide 127*e*, the released yarn 27*e* is held between the yarn introduction member 100 and the yarn holding member 142 and then would on the warper drum A. This yarn change operation is achieved in the same manner as done in the above-mentioned embodiment shown in shown in FIGS. 11 to 19, and further illustration can, therefore, be omitted to avoid duplication.

Another embodiment of the present invention will be described with reference to FIGS. 22 and 23. In these figures, these parts which are similar or corresponding to those shown in FIGS. 20 and 21 are designated by the same reference characters.

Figure 22:
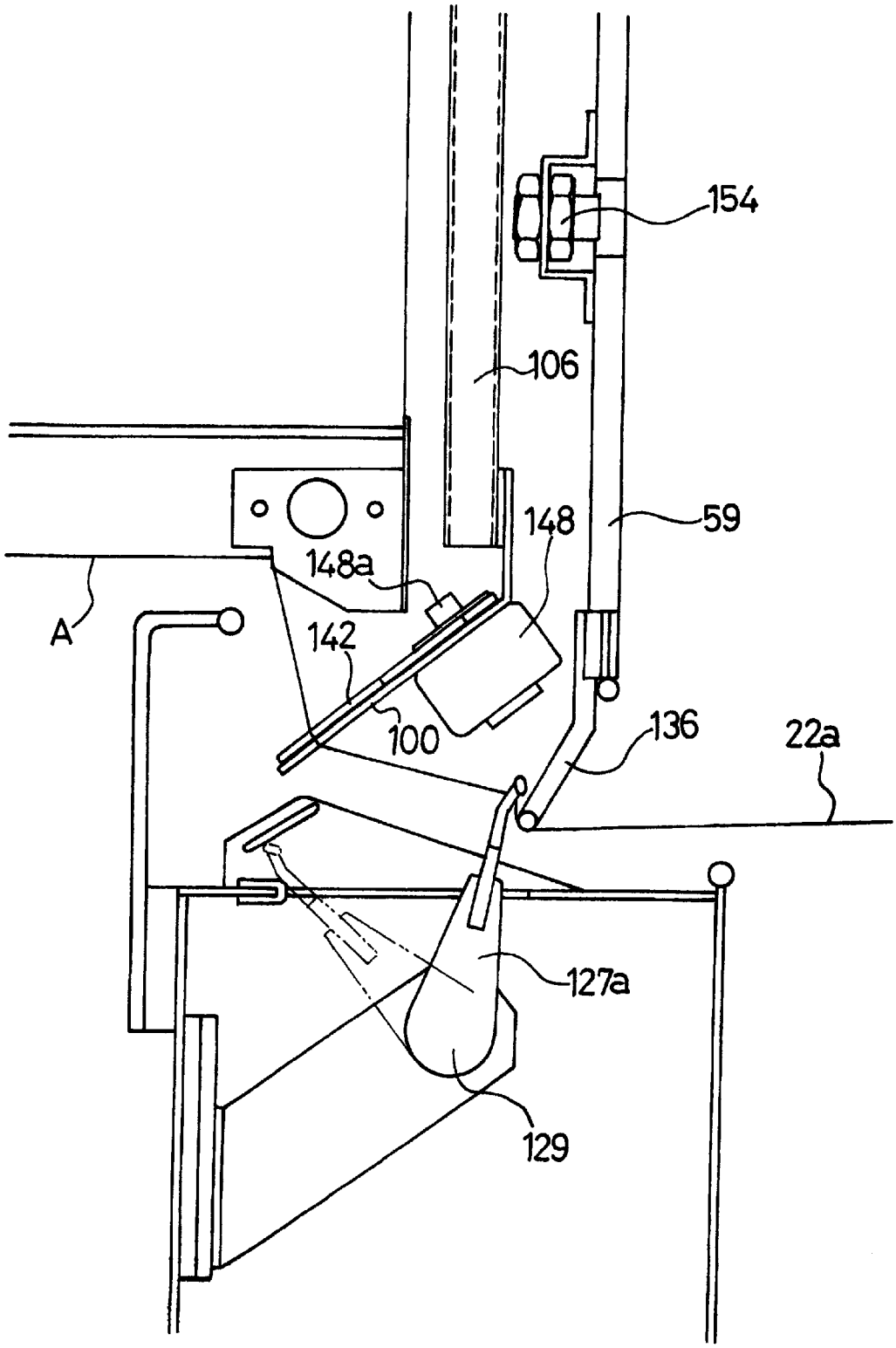
FIG. 22 is a diagrammatical view similar to FIG. 12, but showing still another form of the yarn holding mechanism formed by the yarn introduction member according to the present invention.
Figure 23:
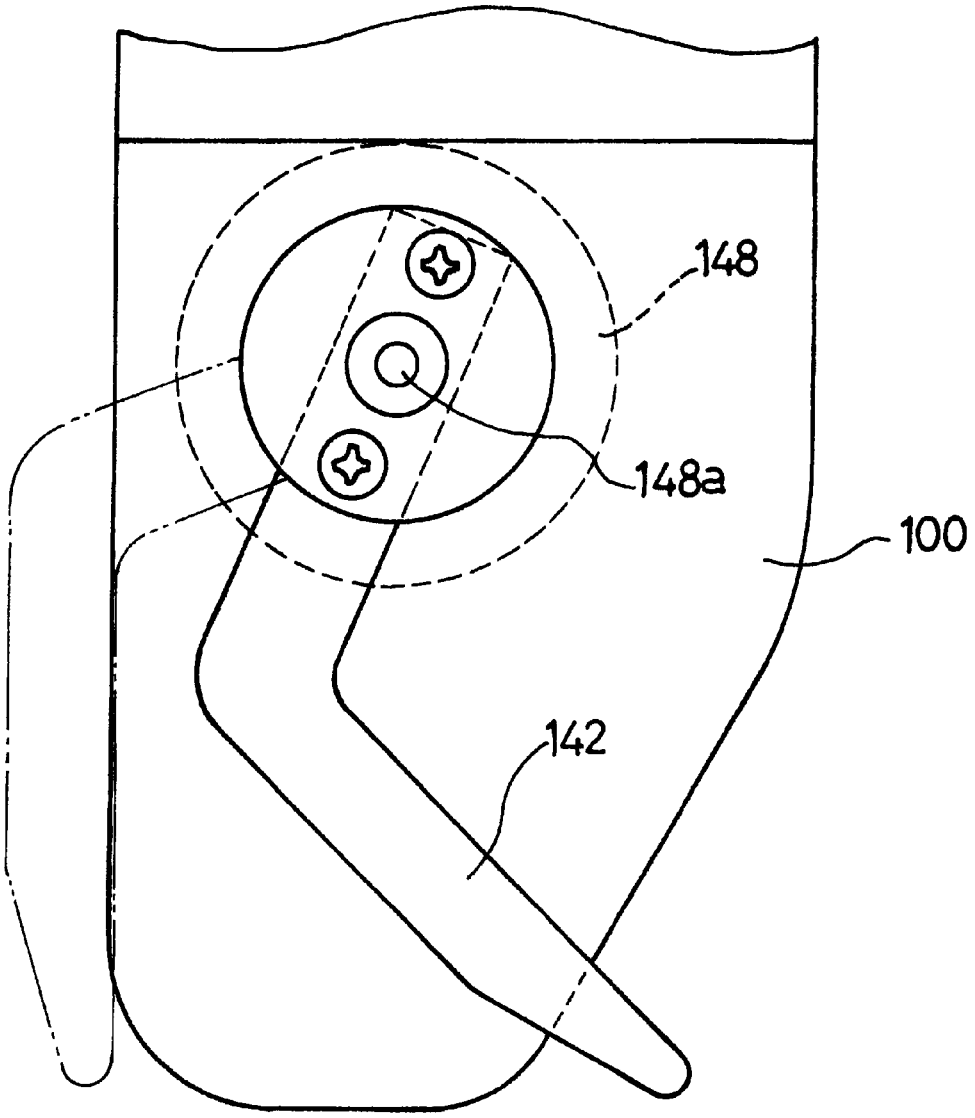
FIG. 23 is a detailed top plan view of the yarn holding mechanism formed by the yarn introduction member shown in FIG. 22.
Figure 24:
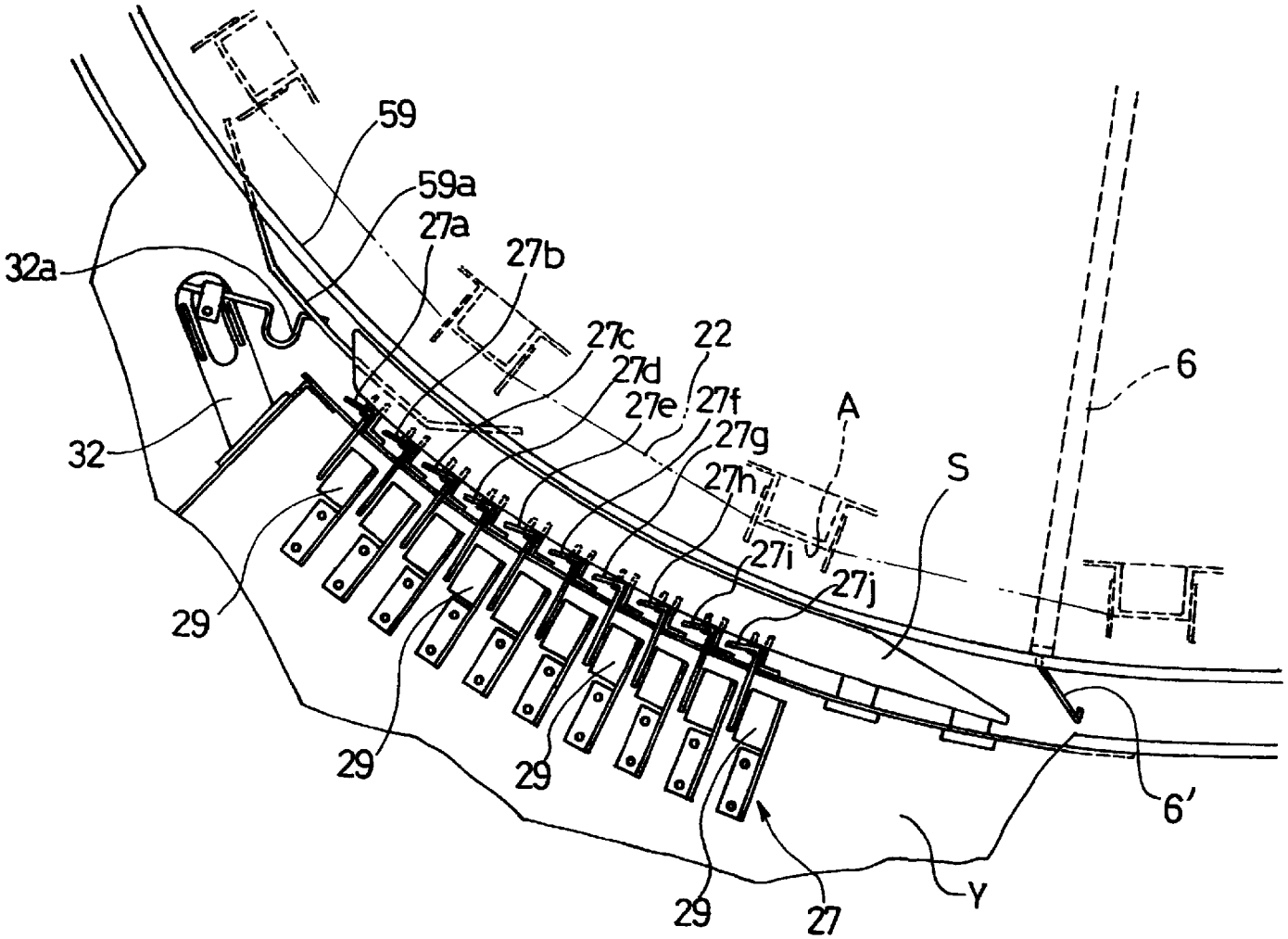
FIG. 24 is a detailed front elevational view, with parts broken away, of a yarn selection guide unit of a conventional electronically controlled sample warper.

As shown in FIGS. 22 and 23, a yarn introduction member 100 is attached to the distal end of a yarn introduction lever 106 (FIG. 22). The yarn introduction member 100 has a rotary solenoid 148 attached thereto. The rotary solenoid 148 has an output shaft 148*a* to which one end of a generally L-shaped yarn holding member 142 is connected so that the yarn holding member 142 is slidable on an upper surface of the yarn introduction member 100.

In FIG. 22, designated by 154 is one of plural sensors disposed in an appropriate position on the yarn introduction cover 59 for detecting the position of the yarn introduction lever 106. Each of the sensors 154 is provided in correspondence with a corresponding one of the yarn selection guides 127*a*–127*j*.

When a yarn change operation is to be performed, one 127*a* of the yarn selection guides holding thereon the yarn being wound 22*a*, for example, is driven to move toward the guide bar 136. Then, after the yarn introduction lever 106 passes the position of the yarn selection guide 127*a*, one of the sensors 154 corresponding to the yarn selection guide 127*a* detects the yarn introduction lever 106 and generates a detection signal to activate the rotary solenoid 148.

When the rotary solenoid 148 is activated, the yarn holding member 142 is angularly moved or turned in a direction to release the yarn 22*a* by virtue of rotation of the output shaft 148*a* of the rotary solenoid 148, as indicated by the phantom lines shown in FIG. 23. As the yarn holding member 142 turns in a direction away from a yarn engagement surface of the yarn introduction member 100, the yarn 22*a* held jointly by the yarn introduction member 100 and the yarn holding member 142 is allowed to slide on the yarn introduction member 100 and then disengaged or released from the yarn introduction member 100.

The released yarn 22*a* is allowed to return between the guide bar 136 and the base Y and abuts against the yarn selection guide 127*a*. Then the yarn selection guide 127*a* is angularly moved from the guide bar 136 side toward the base Y side during that time the released yarn 22*a* is stored on the base Y side while it is held on the yarn selection guide 127*a*.

The rotary solenoid 148, after the lapse of a predetermined time, is returned to its original position. With this return action of the rotary solenoid 148, the yarn holding member 142 turns reversely to the operating position indicated by solid lines shown in FIG. 23 in which the yarn holding member 142 projects outwardly from yarn engagement surface of the yarn introduction guide 100. Then, another yarn selection guide 127*e* holding thereon a yarn 27*e*, for example, to be wound next is angularly moved from the base Y side toward the guide bar 136 side. With this movement of the yarn selection guide 127*e*, the yarn 27*e* held on the yarn selection guide 127*e* is released from the yarn selection guide 127*e*. Subsequently, as the yarn introduction member 100 passes the position of the yarn selection guide 127*e*, the released yarn 127*e* is held between the yarn introduction guide and the yarn holding member 142 and then wound on the warper drum A. This yarn change operation is achieved in the same manner as done in the above-mentioned embodiment shown in shown in FIGS. 11 to 19, and further illustration can, therefore, be omitted to avoid duplication.

It appears clear from the foregoing description that according to the present invention, the length of yarn required for the yarn changing can be reduced to approximately one-half or less of that of the conventional method, and the tension on a yarn is prevented from changing abruptly when the yarn is detached. Thus, the warping quality can be improved and the yarn change speed is increased to approximately twice the yarn change speed of the conventional process wherein the warper quality is degraded due to unstable yarn tension while the yarn exchange is performed. By virtue of the arrangement of the yarn introduction member actuating unit body on the yarn introduction cover, it becomes possible to use a plurality of such yarn introduction member actuating unit bodies which makes it possible to use more than twenty bobbins, leading to successful warping of a complicated design pattern. By contract, according to the conventional sample warper, the total number of bobbins that can be used for yarn change is limited to ten at maximum.

Obviously, various minor changes and modifications of the present invention are possible in the light of the above teaching. It is therefore to be understood that within the scope of the appended claims the invention may be practiced otherwise than as specifically described.

What is claimed is:

1. An electronically controlled sample warper, comprising:

a yarn introduction member movably mounted on a distal end of at least one yarn introduction lever rotatably provided on a side surface of a warper drum for winding a yarn on said warper drum; and a plurality of yarn selection guides disposed, in correspondence with said yarn introduction member, on an end portion of a base on which said warper drum is supported, each of said yarn selection guides being movable angularly about said base between a yarn exchange position in which it projects from said base for changing the yarn to another yarn, and a standby position in which it is retracted in said base for storing the yarn in the base, wherein said yarn introduction member and each of said yarn selection guides are cooperative with each other to undertake delivery of a yarn between them so as to wind yarns on said warper drum in the preset order with automatic yarn change, and wherein when the yarn is to be delivered from said yarn introduction member to one of said yarn selection guides, said yarn introduction member moves in a first direction to release the yarn therefrom to thereby allow the yarn to be caught by said one yarn selection guide, and when the yarn is to be delivered from said one yarn selection guide to said yarn introduction member, said yarn introduction member moves in a second direction to catch the yarn held on said one yarn selection guide.

2. An electronically controlled sample warper according to claim 1, wherein said yarn introduction member is angularly movably attached to said distal end of said yarn introduction lever, and said yarn introduction member is turned in one direction to release the yarn therefrom and in the opposite direction to catch the yarn held on said one yarn selection guide.

3. An electronically controlled sample warper according to claim 1, wherein said yarn introduction member is activated by a plurality of yarn introduction member actuating unit bodies disposed on an end face of said warper drum or a yarn introduction cover disposed on said end face of said warper drum, said yarn introduction member actuating unit bodies being activated in accordance with a preset yarn exchange order so as to operate said yarn introduction member.

4. An electronically controlled sample warper according to claim 2, wherein said yarn introduction member is activated by a plurality of yarn introduction member actuating unit bodies disposed on an end face of said warper drum or a yarn introduction cover disposed on said end face of said warper drum, said yarn introduction member actuating unit bodies being activated in accordance with a preset yarn exchange order so as to operate said yarn introduction member.

5. An electronically controlled sample warper according to claim 3, further including a plurality of sensors mounted on said end face of said warper drum or on said yarn introduction cover for sensing said yarn introduction lever so as to generate a yarn introduction lever detection signal to activate said yarn introduction member actuating unit bodies in said preset yarn exchange order.

6. An electronically controlled sample warper according to claim 4, further including a plurality of sensors mounted on said end face of said warper drum or on said yarn introduction cover for sensing said yarn introduction lever so as to generate a yarn introduction lever detection signal to activate said yarn introduction member actuating unit bodies in said preset yarn exchange order.

7. An electronically controlled sample warper according to claim 1, further including a yarn introduction cover attached to said side surface of said warper drum, and a guide bar attached at its one end to a lower end portion of said yarn introduction cover, the other end of said guide bar being bent in the same direction as the direction of rotation of said yarn introduction member so as to allow the yarn to pass between said guide bar and each of said yarn selection guides both when the yarn is being wound on said warper drum and when the yarn is changed to another yarn.

8. An electronically controlled sample warper according to claim 2, further including a yarn introduction cover attached to said side surface of said warper drum, and a guide bar attached at its one end to a lower end portion of said yarn introduction cover, the other end of said guide bar being bent in the same direction as the direction of rotation of said yarn introduction member so as to allow the yarn to pass between said guide bar and each of said yarn selection guides both when the yarn is being wound on said warper drum and when the yarn is changed to another yarn.

9. An electronically controlled sample warper, comprising:

a yarn introduction member movably mounted on a distal end of at least one yarn introduction lever rotatably provided on a side surface of a warper drum for winding a yarn on said warper drum; and a plurality of yarn selection guides disposed, in correspondence with said yarn introduction lever, on an end portion of a base on which said warper drum is supported, each of said yarn selection guides being movable angularly about said base between a yarn exchange position in which it projects from said base for changing the yarn to another yarn, and a standby position in which it is retracted in said base for storing the yarn in the base, wherein said yarn introduction member and each of said yarn selection guides are cooperative with each other to undertake delivery of a yarn between them so as to wind yarns on said warper drum in the preset order with automatic yarn change, wherein said yarn introduction member has a yarn holding member movably mounted thereon, and wherein when the yarn is to be delivered from said yarn introduction member to one of said yarn selection guides, said yarn holding member moves in a first direction to release the yarn therefrom to thereby allow the yarn to be caught by said one yarn selection guide, and when the yarn is to be delivered from said one yarn selection guide to said yarn introduction member, said yarn holding member moves in a second direction to catch the yarn held on said one yarn selection guide.

10. An electronically controlled sample warper according to claim 9, wherein said yarn holding member is attached to a distal end of said yarn introduction member so as to be reciprocally movable between a first position in which it is retracted into said yarn introduction member to release the yarn, and a second position in which it projects from said yarn introduction member to catch the yarn.

11. An electronically controlled sample warper according to claim 9, wherein said yarn holding member is angularly movably attached to a distal end of said yarn introduction member, and said yarn holding member is turned in one direction to retract into said yarn introduction member for releasing the yarn therefrom and in the opposite direction to project from said yarn introduction member for catching and holding the yarn.

12. An electronically controlled sample warper according to claim 9, further including a plurality of sensors mounted on said end face of said warper drum or on said yarn introduction cover for sensing said yarn introduction lever so as to generate a yarn introduction lever detection signal to activate said yarn holding members in said preset yarn exchange order.

13. An electronically controlled sample warper according to claim 10, further including a plurality of sensors mounted on said end face of said warper drum or on said yarn introduction cover for sensing said yarn introduction lever so as to generate a yarn introduction lever detection signal to activate said yarn holding members in said preset yarn exchange order.

14. An electronically controlled sample warper according to claim 11, further including a plurality of sensors mounted on said end face of said warper drum or on said yarn introduction cover for sensing said yarn introduction lever so as to generate a yarn introduction lever detection signal to activate said yarn holding members in said preset yarn exchange order.

15. An electronically controlled sample warper according to claim 9, further including a yarn introduction cover attached to said side surface of said warper drum, and a guide bar attached at its one end to a lower end portion of said yarn introduction cover, the other end of said guide bar being bent in the same direction as the direction of rotation of said yarn introduction member so as to allow the yarn to pass between said guide bar and each of said yarn selection guides both when the yarn is being wound on said warper drum and when the yarn is changed to another yarn.

16. An electronically controlled sample warper according to claim 10, further including a yarn introduction cover attached to said side surface of said warper drum, and a guide bar attached at its one end to a lower end portion of said yarn introduction cover, the other end of said guide bar being bent in the same direction as the direction of rotation of said yarn introduction member so as to allow the yarn to pass between said guide bar and each of said yarn selection guides both when the yarn is being wound on said warper drum and when the yarn is changed to another yarn.

17. An electronically controlled sample warper according to claim 11, further including a yarn introduction cover attached to said side surface of said warper drum, and a guide bar attached at its one end to a lower end portion of said yarn introduction cover, the other end of said guide bar being bent in the same direction as the direction of rotation of said yarn introduction member so as to allow the yarn to pass between said guide bar and each of said yarn selection guides both when the yarn is being wound on said warper drum and when the yarn is changed to another yarn.

* * * * *